US006562561B1

(12) United States Patent
Naoi

(10) Patent No.: US 6,562,561 B1
(45) Date of Patent: May 13, 2003

(54) HEAT-DEVELOPABLE IMAGE-RECORDING MATERIAL

(75) Inventor: Takashi Naoi, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/357,963

(22) Filed: Jul. 21, 1999

(30) Foreign Application Priority Data

Jul. 21, 1998 (JP) ..... 10-221039

(51) Int. Cl.[7] ..... G03C 1/498; G03C 1/91; G03C 1/735

(52) U.S. Cl. ..... 430/619; 430/523; 430/531; 430/534; 430/950

(58) Field of Search ..... 430/619, 531, 430/534, 523, 627, 950

(56) References Cited

U.S. PATENT DOCUMENTS

| | | | | | |
|---|---|---|---|---|---|
| 2,779,684 | A | * | 1/1957 | Alles | |
| 3,944,699 | A | * | 3/1976 | Mathews et al. | 428/220 |
| 4,187,113 | A | * | 2/1980 | Mathews et al. | 430/533 |
| 4,780,402 | A | * | 10/1988 | Remmington | 430/533 |
| 4,954,430 | A | * | 9/1990 | Ishigaki et al. | 430/534 |
| 4,977,071 | A | | 12/1990 | Kanetake et al. | |
| 5,059,579 | A | * | 10/1991 | Hart et al. | 503/227 |
| 5,914,220 | A | * | 6/1999 | Murayama | 430/349 |
| 6,060,226 | A | * | 5/2000 | Hashimoto | 430/496 |

FOREIGN PATENT DOCUMENTS

| | | | |
|---|---|---|---|
| EP | 0279450 | A2 | 8/1988 |
| EP | 0779539 | A1 | 6/1997 |
| EP | 0810467 | A1 | 12/1997 |
| EP | 0810468 | A1 | 12/1997 |
| EP | 0821269 | A1 | 1/1998 |
| EP | 0902322 | A1 | 3/1999 |
| EP | 0279450 | B1 | 5/1999 |
| GB | 1234755 | | 6/1971 |
| JP | 02271350 | | 11/1990 |

* cited by examiner

*Primary Examiner*—Thorl Chea
(74) *Attorney, Agent, or Firm*—Birch, Stewart, Kolasch & Birch, LLP.

(57) ABSTRACT

A heat-developable image-recording material which is heat-developed at a development temperature of from 80° C. to 140° C., and comprises, on both sides of a support, undercoat layers comprising a vinylidene chloride copolymer containing at least 70% by weight of vinylidene chloride monomer repeating units and having a thickness of 0.3 $\mu$m or more for each.

13 Claims, 1 Drawing Sheet

HEAT-DEVELOPABLE IMAGE-RECORDING MATERIAL

FIELD OF THE INVENTION

The present invention relates to a heat-developable image-recording material used for, in particular, photomechanical processes. More precisely, the present invention relates to a heat-developable image-recording material for scanners or image setters, particularly, a heat-developable image-recording material suitable for color photomechanical processes, which is free from wrinkles and excellent in dimensional stability upon heat development.

BACKGROUND OF THE INVENTION

As one of the light exposure methods of photographic light-sensitive materials, there has been known a method for image formation of so-called scanner type, wherein an original is scanned, and a silver halide photographic material is light-exposed based on the obtained image signals to form a negative or positive image corresponding to the image on the original.

In the case where an image output from a scanner on a film is further printed directly on a printing plate without a reversal step, or a scanner light source having a soft beam profile, a light-sensitive material for scanners exhibiting ultra-high contrast property has been desired.

A large number of light-sensitive materials comprising a support having thereon a light-sensitive layer are known, where the image formation is performed by imagewise exposing of the light-sensitive material. Of these, a technique of forming an image by heat development is a system capable of satisfying the issue of environmental protection or simplifying the image formation means.

In recent years, reduction of the amount of waste processing solutions is keenly demanded in the field of photomechanical processes from the standpoint of environmental protection and space savings. To cope with this, techniques are required to produce light-sensitive heat-developable materials for use in photomechanical processes, which can be effectively exposed by a laser scanner or laser image setter and can form a clear black image having high resolution and sharpness. Such light-sensitive heat-developable materials can provide to users a simple heat development processing system which is dispensable uses solution-type processing chemicals, and does not destroy the environment.

Methods for forming an image by heat development are described, for example, in U.S. Pat. Nos. 3,152,904 and 3,457,075 and D. Morgan and B. Shely, Imaging Processes and Materials, "Thermally Processed Silver Systems" A, 8th ed., page 2, compiled by Sturge, V. Walworth and A. Shepp, Neblette (1969). The light-sensitive material used contains a light-insensitive silver source (e.g., organic silver salt) capable of reduction, a photocatalyst (e.g., silver halide) in a catalytic activity amount, and a reducing agent for silver, which are usually dispersed in an organic binder matrix. This light-sensitive material is stable at room temperature. However, when it is heated at a high temperature (e.g., 80° C. or higher) after the exposure, silver is produced through an oxidation-reduction reaction between the silver source (which functions as an oxidizing agent) capable of reduction and the reducing agent. The oxidation-reduction reaction is accelerated by the catalytic action of a latent image generated upon exposure. The silver produced by the reaction of the silver salt capable of reduction in the exposure region provides a black image and this presents a contrast to the non-exposure region. Thus, an image is formed.

Although heat-developable light-sensitive materials of this type have hitherto been known, most of those light-sensitive materials utilize a polyester film as a support produced by stretching, and hence suffer from a drawback that images are deformed upon heat development due to thermal dimensional change (mainly thermal shrinkage) of the support.

Further, a binder contained in the image-forming layer also simultaneously causes dehydration shrinkage and thermal expansion upon heat development, and these phenomena produce wrinkles of the film because they are different from thermal behavior of the support. Thus, only films unsuitable for color printing, wherein the films are laminated for use, are eventually produced.

As techniques for preventing such dimensional change and wrinkles arisen from the heat development, there have been proposed various thermal treatments for relaxing internal distortion produced during the film production by stretching. For example, JP-A-3-24936 (the code "JP-A" as used herein means an "unexamined published Japanese patent application"), JP-A-64-64833, JP-A-8-211547, JP-A-3-97523, JP-A-61-154829, JP-A-3-97523, JP-A-57-109946 and the like can be mentioned.

In fact, the methods disclosed in those documents can alleviate the degree of thermal shrinkage of supports produced as films by biaxial stretching. However, they cannot reduce the dimensional change over time after the heat development.

A color photomechanical process is carried out by using four films for the four colors, i.e., Y, M, C and K. When these four films are simultaneously subjected to light exposure and heat development, any particular problem is not caused. However, the light exposure and the heat development are often performed on different occasions for these four films. In such a case, because the time after the heat development is different for each film, the sizes of the films may not fit each other, which often causes color deviation.

Therefore, there has been desired a technique capable of providing a heat-developable light-sensitive material exhibiting excellent dimensional stability irrespective of handling conditions.

Accordingly, an object of the present invention is to provide a heat-developable image-recording material that shows small dimensional change over time after the heat development and small dimensional change before and after the heat development, and is free from generation of wrinkles during the heat treatment. Another object of the present invention is to provide a heat-developable image-recording material affording images of excellent photographic properties.

SUMMARY OF THE INVENTION

The aforementioned objects have been achieved by the present invention, which provides a heat-developable image-recording material which is heat-developed at a development temperature of from 80° C. to 140° C., and comprises, on both sides of a support, undercoat layers comprising a vinylidene chloride copolymer containing at least 70% by weight of vinylidene chloride monomer repeating units and having a thickness of 0.3 $\mu$m or more for each.

In a preferred embodiment of the present invention, an image-forming layer containing an organic silver salt, reducing agent, and light-sensitive silver halide is provided on the support. On the image-forming layer, at least one protective layer is preferably provided. The vinylidene chloride copolymer preferably contains 70–99.9% by weight of the vinylidene chloride monomer repeating units and 0.1–5% by weight of carboxyl group-containing vinyl monomer repeating units. The vinylidene chloride copolymer preferably has a weight average molecular weight of 45000 or less. The support is preferably composed of biaxially stretched polyester. The heat-developable image-recording material of the present invention is preferably subjected to heat treatment at a temperature of 130° C. to 185° C. after the undercoat layers are coated on the support. The rate of heat dimensional change of the heat-treated support, when it is heated at 120° C. for 30 seconds, is preferably −0.03% to 0.01% for the machine direction (MD), and 0% to 0.04% for the transverse direction (TD). As binders for the image-forming layer and the protective layer, a polymer latex is preferably used.

BRIEF DESCRIPTION OF THE DRAWING

In FIG. 1, there are shown a halogen lamp 1, heat drum 2, feed rollers 3, continuous belt 4, heat-developable image-recording material 5, exit 6, straightening guide panel 7, feed roller pair 8, flat guide panels 9, feed roller pair 10, and cooling fans 11.

PREFERRED EMBODIMENT OF THE INVENTION

Figure 1:
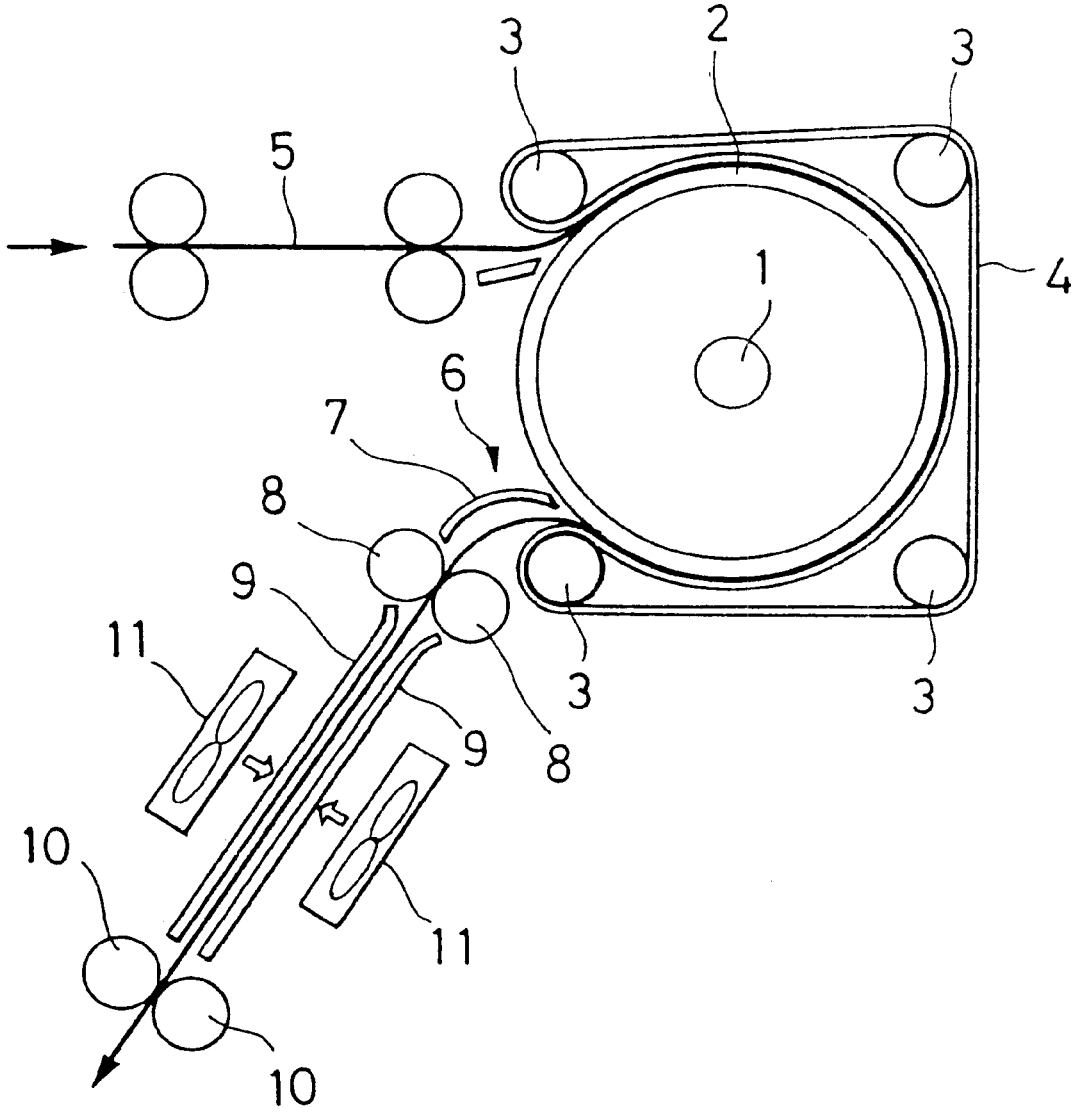
FIG. 1 is a side view of an exemplary heat developing apparatus used for the present invention.

The present invention will be explained in detail hereinafter.

In the heat-developable image-recording material of the present invention, images are formed by heat development, and the development temperature therefor is 80° C. to 140° C. Heating in this heat development includes not only heating for image formation but also preheating for suppressing ununiform processing and the like. Therefore, the development may be performed at a constant temperature, or performed as multi-step heating comprising, for example, heating at constant temperature and subsequent heating at an elevated temperature.

In such a heat-developable image-recording material, the dimensional change over time after the heat development can be prevented by using a support which is coated on both sides with undercoat layers comprising a vinylidene chloride copolymer and having a thickness of 0.3 μm or more (total thickness for each side). It also makes it possible to eliminate generation of wrinkles and prevent dimensional change caused upon the heat development. Therefore, the aforementioned dimensional change over time after the heat development becomes very small. A biaxially stretched polyester support is preferably used for the present invention. In case of such a support, in particular, dimensional change and generation of depressions of the support itself due to heating can be prevented by performing heat treatment preferably after the undercoat layers are provided. Therefore, by employing a polyester support undergone such a treatment as the support of the heat-developable image-recording material, the generation of wrinkles upon heat development of the heat-developable image-recording material can be eliminated, and the dimensional change before and after the heat development can be made small. Therefore, a polyester support preferably used for the present invention is preferably subjected to a heat treatment at a temperature of 130° C. to 185° C., preferably after the undercoat layers containing vinylidene chloride are provided.

In contrast, unlike the present invention, if only a polymer other than a vinylidene chloride copolymer (for example, styrene/butadiene copolymer) is used for the undercoat layers coating the both sides of the support, the dimensional change over time after the heat development cannot be prevented. Further, if the thickness of these undercoat layers is less than 0.3 μm (total thickness for each side), the dimensional change over time after the heat development cannot also be prevented.

The heat-developable image-recording material of the present invention preferably comprises, on the polyester support whose both surfaces are coated with the undercoat layers containing a vinylidene chloride copolymer, an image-forming layer containing an organic silver salt, reducing agent, and light-sensitive silver halide, and at least one protective layer provided on the image-forming layer. The heat-developable image-recording material of the present invention preferably further comprises at least one back layer on the support for the side opposite to the one having the image-forming layer. As binders of the image-forming layer, protective layer and back layer, if present, a hydrophobic synthetic polymer, hydrophobic natural polymer and the like are used.

Use of a polymer latex of these polymers and the vinylidene chloride copolymer enables aqueous application utilizing a solvent (dispersion medium) mainly composed of water, which is particularly preferred because of the advantages concerning environmental protection and cost. However, the desired effect may also be obtained in a heat-developable image-recording material obtained by solution coating of the polymers dissolved in various organic solvents as binder.

Undercoat layers containing a vinylidene chloride copolymer is provided on both sides of the support of the present invention. The vinylidene chloride copolymer for this contains 70% by weight or more of vinylidene chloride monomer repeating units (also referred to as "vinylidene chloride monomers" hereinafter). When the vinylidene chloride monomer content is less than 70% by weight, sufficient moisture barrier property cannot be obtained, and hence the dimensional change over time after the heat development becomes large. The vinylidene chloride copolymer preferably contains carboxyl group-containing vinyl monomer repeating units (also referred to as "carboxyl group-containing vinyl monomers") as repeating units other than the vinylidene chloride monomers. Such structural repeating units are contained because the vinyl chloride monomers alone afford crystallization of the polymer, which makes it difficult to form a uniform film when the moisture barrier layer is coated, and the carboxyl group-containing vinyl monomers are indispensable for stabilization of the polymer.

The vinylidene chloride copolymer of the present invention is a copolymer preferably containing 70–99.9% by weight, more preferably 85–99% by weight of vinylidene chloride monomers and preferably 0.1–5% by weight, more preferably 0.2–3% by weight of carboxyl group-containing vinyl monomers.

The carboxyl group-containing vinyl monomer used for the vinylidene chloride copolymer of the present invention is a vinyl monomer having one or more carboxyl groups in a molecule, and specific examples thereof include, for example, acrylic acid, methacrylic acid, itaconic acid, citraconic acid and the like.

The vinylidene chloride copolymer of the present invention may contain repeating units of monomers other than the vinylidene chloride monomer and the carboxyl group-containing monomer, which are copolymerizable with these monomers.

Examples of such monomers include, for example, acrylonitrile, methacrylonitrile, methyl acrylate, ethyl acrylate, methyl methacrylate, glycidyl methacrylate, 2-hydroxyethyl methacrylate, vinyl acetate, acrylamide, styrene, and the like.

These monomers can be used individually, or in any combination of two or more of them.

The molecular weight of the vinylidene chloride copolymer of the present invention is preferably 45000 or less, more preferably 10000 to 45000 in terms of weight average molecular weight. When the molecular weight becomes too large, adhesion between the vinylidene chloride copolymer layer and the support layer of polyester or the like is degraded.

The vinylidene chloride copolymer of the present invention may be used by dissolving it in an organic solvent, or as an aqueous dispersion of latex. However, the aqueous dispersion of latex is preferred.

In the latter case, the latex may be a latex having a uniform structure, or a so-called core/shell type latex comprising core and shell with different compositions.

The particle size of the polymer particles in the latex may be similar to those used for the binder of the image-forming layer or the protective layer explained hereinafter.

The sequence of the monomeric units of the vinylidene chloride copolymer is not particularly limited, and it may show periodicity or randomness, or may be composed of blocks.

The following can be mentioned as specific examples of the vinylidene chloride copolymer of the present invention. The parenthesized numerals indicate weight ratios. The average molecular weights represent weight average molecular weights.

V-1: latex of vinylidene chloride/methyl acrylate/acrylic acid (90:9:1, average molecular weight of 42000);

V-2: latex of vinylidene chloride/methyl acrylate/methyl methacrylate/acrylonitrile/methacrylic acid (87:4:4:4:1, average molecular weight of 40000);

V-3: latex of vinylidene chloride/methyl methacrylate/glycidyl methacrylate/methacrylic acid (90:6:2:2, average molecular weight of 38000);

V-4: latex of vinylidene chloride/ethyl methacrylate/2-hydroxyethyl methacrylate/acrylic acid (90:8:1.5:0.5, average molecular weight of 44000);

V-5: core shell type latex (90% by weight of core and 10% by weight of shell, average molecular weight of 38000); Core: vinylidene chloride/methyl acrylate/methyl methacrylate/acrylonitrile/acrylic acid (93:3:3:0.9:0.1); Shell: vinylidene chloride/methyl acrylate/methyl methacrylate/acrylonitrile/acrylic acid (88:3:3:3:3);

V-6: core shell type latex (70% by weight of core and 30% by weight of shell, average molecular weight of 20000); Core: vinylidene chloride/methyl acrylate/methyl methacrylate/acrylonitrile/methacrylic acid (92.5:3:3:1:0.5);

Shell: vinylidene chloride/methyl acrylate/methyl methacrylate/acrylonitrile/methacrylic acid (90:3:3:1:3).

The vinylidene chloride copolymers may be used individually, or in any combination of two or more of them.

The vinylidene chloride copolymer of the present invention is used in such an amount that the undercoat layer containing the vinylidene chloride copolymer should have a total thickness for one side of 0.3 μm or more, preferably 0.3 to 4 μm.

The vinylidene chloride copolymer layer as the undercoat layer is preferably provided as the first undercoat layer that is directly coated on the support. While one undercoat layer is usually provided for each side, two or more layers may be provided as the case may be. When a multiple-layer structure composed of two or more layers is used, the vinylidene chloride copolymer amount range defined by the present invention may be satisfied by the total amount of the vinylidene chloride copolymers in such layers.

Because the vinylidene chloride copolymer layer usually has a monolayer structure as mentioned above, the thickness is preferably 0.3 to 4 μm, more preferably 0.6 to 3 μm, particularly preferably 1.0 to 2 μm in order to obtain a good applied surface condition.

This layer may contain, other than the vinylidene chloride copolymer, a crosslinking agent, matting agent and the like.

For the heat-developable image-recording material of the present invention, various kinds of support can be used. Typical supports comprises polyester such as polyethylene terephthalate, and polyethylene naphthalate, cellulose nitrate, cellulose ester, polyvinylacetal, polycarbonate or the like. Among these, biaxially stretched polyester, especially polyethylene terephthalate (PET), is preferred in view of strength, dimensional stability, chemical resistance and the like. The support preferably has a thickness of 90–180 μm as a base thickness except for the undercoat layer.

Preferably used as the support of the heat-developable image-recording material of the present invention is a polyester film, in particular polyethylene terephthalate film, subjected to a heat treatment in a temperature range of 130–185° C. in order to relax the internal distortion formed in the film during the biaxial stretching so that thermal shrinkage distortion occurring during the heat development should be eliminated. Such a thermal relaxation treatment may be performed at a constant temperature within the above temperature range, or it may be performed with raising the temperature.

The heat treatment of the support may be performed for the support in the form of a roll, or it may be performed for the support that is conveyed as a web. When it is performed for a support that is conveyed as a web, it is preferred that the conveying tension should be not more than 7 kg/cm$^2$, in particular, not more than 4.2 kg/cm$^2$. The lower limit of the conveying tension is, while not particularly limited, 0.5 kg/cm$^2$ or so.

This heat treatment is preferably performed after a treatment for improving adhesion of the image-forming layer and the back layer to the support, application of the undercoat layer and the like.

The thermal shrinkage of the support upon heating at 120° C. for 30 seconds is preferably −0.03% to +0.01% for the machine direction (MD), and 0 to 0. 04% for the transverse direction (TD).

The support may be applied with, other than the vinylidene chloride layer, an undercoat layer containing SBR, polyvinylidene chloride, polyester, gelatin or the like as a binder, as required. The undercoat layer may be composed of multiple layers, and may be provided on one side or both sides of the support. At least one of the undercoat layers may be an electroconductive layer. The undercoat layer generally has a thickness of 0.01–5 μm, more preferably 0.05–1 μm (for one layer). When it is an electroconductive layer, it preferably has a thickness of 0.01–1 μm, more preferably 0.03–0.8 μm.

The binder for the image-forming layer, protective layer, back layer and the like will be explained hereinafter.

Polymer binders preferably used for the binder of the present invention comprises water-insoluble hydrophobic polymer fine particles dispersed in a water-soluble dispersion medium. With respect to the dispersion state, the polymer may be emulsified in the dispersion medium, emulsion-polymerized or micell dispersed or the polymer may have a partially hydrophilic structure in the polymer molecule so that the molecular chain itself is dispersed in the molecule. The polymer latex for use in the present invention is described in Gosei Jushi Emulsion (Synthetic Resin Emulsion), compiled by Taira Okuda and Hiroshi Inagaki, issued by Kobunshi Kanko Kai (1978), Gosei Latex no Oyo (Application of Synthetic Latex), compiled by Takaaki Sugimura, Yasuo Kataoka, Souichi Suzuki and Keishi Kasahara, issued by Kobunshi Kanko Kai (1993), and Soichi Muroi, Gosei Latex no Kagaku (Chemistry of Synthetic Latex), Kobunshi Kanko Kai (1970) and the like. The dispersion particles preferably have an average particle size of from 1 to 50,000 nm, more preferably on the order of from 5 to 1,000 nm. The particle size distribution of the dispersed particles is not particularly limited, and the dispersed particles may have a broad particle size distribution or a monodisperse particle size distribution.

As the polymer binder used for the present invention, a so-called core/shell type latex may be used other than the normal polymer latex having a uniform structure. In this case, it is preferred in some cases that the core and the shell have different glass transition temperatures.

The polymer latex used as the binder in the present invention has a glass transition temperature (Tg) of which preferred range may be different among those for the protective layer, the back layer and the image-forming layer. In the protective layer and the back layer, the glass transition temperature is preferably 25° C. to 100° C. in view of film strength and prevention of adhesion failure, because the protective layer and the back layer are brought into contact with various instruments. In the image-forming layer, the glass transition temperature is preferably from −30° C. to 40° C., particularly preferably from 0° C. to 40° C. so as to accelerate the diffusion of the photographically useful materials during the heat development, and to obtain good photographic properties such as high Dmax and low fogging. The gel fraction of the polymer latex used for the image-forming layer is desirably 30–90% by weight for similar reasons. The gel fraction in this case is one obtained according to the following equation by forming a film sample from a polymer latex at a drying temperature of 70° C., immersing the film sample in tetrahydrofuran (THF) at 25° C. for 24 hours, and measuring the amount of insoluble matter.

$$\text{Gel fraction (wt \%)} = [\text{Weight of insoluble matter (g)}/\text{Weight of film using polymer latex (g)}] \times 100$$

The polymer latex for use in the present invention preferably has a minimum film-forming temperature (MFT) of from −30 to 90° C., more preferably from 0 to 70° C. In order to control the minimum film-forming temperature, a film-forming aid may be added. The film-forming aid is also called a plasticizer and it is an organic compound (usually an organic solvent) capable of reducing the minimum film-forming temperature of the polymer latex. This organic compound is described in Souichi Muroi, Gosei Latex no Kagaku (Chemistry of Synthetic Latex), Kobunshi Kanko Kai (1970), ibid.

The polymer species of the polymer latex for use in the present invention may be of acrylic resin, vinyl acetate resin, polyester resin, polyurethane resin, rubber-based resin, vinyl chloride resin, vinylidene chloride resin, polyolefin resin or a copolymer thereof. The polymer may be a straight-chained polymer, a branched polymer or a cross-linked polymer. The polymer may be a so-called homopolymer obtained by polymerizing a single kind of monomers or may be a copolymer obtained by polymerizing two or more kinds of monomers. The copolymer may be either a random copolymer or a block copolymer. The polymer preferably has a number average molecular weight of from 5,000 to 1,000,000, more preferably on the order of from 10,000 to 100,000. If the molecular weight is too small, the image-forming layer is deficient in the mechanical strength, whereas if it is excessively large, the film-forming property is disadvantageously poor.

Specific examples of the polymer latex used as a binder in the image-forming layer of the heat-developable image-recording material of the present invention include a methyl methacrylate/ethyl acrylate/methacrylic acid copolymer latex, methyl methacrylate/2-ethylhexyl acrylate/hydroxyethyl methacrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex and vinylidene chloride/ethyl acrylate/acrylonitrile/methacrylic acid copolymer latex. Such polymers are also commercially available and examples of the polymer which can be used include acrylic resins such as CEBIAN A-4635, 46583, 4601 (all produced by Dicel Kagaku Kogyo Co., Ltd), Nipol Lx811, 814, 821, 820, 857, 857×2 (all produced by Nippon Zeon Co., Ltd.), VONCORT R3340, R3360, R3370, 4280, 2830, 2210 (all produced by Dai-Nippon Ink & Chemicals, Inc.), Julimer ET-410, 530, SEK101-SEK301, FC30, FC35 (all produced by Nihon Junyaku Co., Ltd.), Polysol F410, AM200, AP50 (all produced by Showa Kobunshi Co., Ltd.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40, VONDIC 1320NS (all produced by Dai-Nippon Ink & Chemicals, Inc.); rubber-based resins such as LACSTAR 7310K, 3307B, 4700H, 7132C, LQ-618-1 (all produced by Dai-Nippon Ink & Chemicals, Inc.), Nipol Lx416, 410, 430, 435, 2507 (all produced by Nippon Zeon Co., Ltd.); vinyl chloride resins such as Nipol G351, G576 (both produced by Nippon Zeon Co., Ltd.); vinylidene chloride resins such as L502, L513 (both produced by Asahi Chemical Industry Co., Ltd.), ARON D7020, D5040, D5071 (all produced by Toagosei Co., Ltd.); and olefin resins such as CHEMIPEARL S120 and SA100 (both produced by Mitsui Petrochemical Industries, Ltd.) and the like. These polymers may be used individually or if desired, as a blend of two or more thereof.

Among these polymer latexes, preferably used as the binder for the protective layer are those based on acrylic compound, styrene, acrylic compound/styrene, vinyl chloride, and vinylidene chloride. Specifically, those of acrylic resin type such as VONCORT R3370, 4280, Nipol Lx857, and methyl methacrylate/2-ethylhexyl acrylate/hydroxyethyl methacrylate/styrene/acrylic acid copolymers; those of vinyl chloride resin type such as Nipol G576; and those of vinylidene chloride resin type such as Aron D5071 are preferably used.

As the binder for the image-forming layer, polymer latexes based on styrene/butadiene are preferably used. Specifically, those of rubber resin type such as LACSTAR 3307B, Nipol Lx430 and 435 are preferably used.

As the binder for the back layer, polymer latexes based on acrylic compound, olefin, and vinylidene chloride are preferably used. Specifically, those of acrylic resin type such as Julimer ET-410, CEBIAN A-4635 and Polysol F410, olefin resin type such as CHEMIPEARL S120, vinylidene chloride type such as L502 and ARON D7020 and the like are preferred.

The binder used for the present invention may contain a hydrophilic polymer, if desired, in an amount of 20% by weight or less of the entire binder, such as polyvinyl alcohol, methyl cellulose, hydroxypropyl cellulose, carboxymethyl cellulose and hydroxypropylmethyl cellulose. The amount of the hydrophilic polymer added is preferably 10% by weight or less of the entire binder in the protective layer or the image-forming layer.

The photographic layer of the present invention is preferably formed by coating an aqueous coating solution and then drying it. The term "aqueous" as used herein means that 60% by weight or more of the solvent (dispersion medium) in the coating solution is composed of water. The component other than water of the coating solution may be a water-miscible organic solvent such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

The total binder amount in the protective layer according to the present invention is preferably from 0.2 to 5.0 g/m$^2$, more preferably from 0.5 to 3.0 g/m$^2$.

The total binder amount in the image-forming layer according to the present invention is preferably from 0.2 to 30 g/m$^2$, more preferably from 1.0 to 15 g/m$^2$.

The total binder amount in the back layer according to the present invention is preferably from 0.01 to 3 g/m$^2$, more preferably from 0.05 to 1.5 g/m$^2$.

Each layer may contain a crosslinking agent for crosslinking, surfactant for improving coatability and the like.

Two or more layers may be provided for each of these layers. When the image-forming layer is composed of two or more layers, it is preferred that all of the layers contain a polymer latex as a binder. The protective layer is provided on the image-forming layer, and it may also be composed of two or more layers. In such a case, it is preferred that at least one layer thereof, in particular, the outermost layer of the protective layer contains a polymer latex as a binder. The back layer is provided on an undercoat layer provided on the back face of the support, and it may also be composed of two or more layers. In such a case, it is preferred that at least one layer thereof, in particular, the outermost layer of the back layer contains a polymer latex as a binder.

The back layer next to the support of the heat-developable image-recording material of the present invention and the undercoat layer preferably contain metal oxides in order to reduce dust adhesion, and it is preferred that at least one of the back layer and the undercoat layer (those provided on the both side of the support) should be an electroconductive layer. However, the electroconductive layer is preferably not the outermost layer of the back layer.

As the metal oxide used for this, those disclosed in JP-A-61-20033 and JP-A-56-82504 are particularly preferred.

According to the present invention, the amount of the electroconductive metal oxide is preferably 0.05–20 g, particularly preferably 0.1–10 g per 1 m$^2$ of the image-recording material. Surface resistivity of the metal oxide-containing layer is not more than $10^{12}\Omega$, preferably not more than $10^{11}\Omega$ under an atmosphere of 25° C. and 25% RH. Such surface resistivity affords good antistatic preperty. The lower limit of the surface resistivity is not particularly limited, but it is generally around $10^{7}\Omega$.

According to the present invention, further improved antistatic property can be obtained by using a fluorine-containing surfactant in addition to the aforementioned metal oxide.

The preferred fluorine-containing surfactants for use in the invention are surfactants which have a fluoroalkyl, fluoroalkenyl or fluoroaryl group which has at least 4 carbon atoms (usually 15 or less), and which have, as ionic groups, anionic groups (for example, sulfonic acid or salts thereof, sulfuric acid or salts thereof, carboxylic acid or salts thereof, phosphoric acid or salts thereof), cationic groups (for example, amine salts, ammonium salts, aromatic amine salts, sulfonium salts, phosphonium salts), betaine groups (for example, carboxyamine salts, carboxyammonium salts, sulfoamine salts, sulfoammonium salts, phosphoammonium salts), or non-ionic groups (substituted or unsubstituted poly(oxyalkylene) groups, polyglyceryl groups or sorbitane residual groups).

Such fluorine-containing surfactants have been disclosed, for example, in JP-A-49-10722, British Patent 1,330,356, U.S. Pat. Nos. 4,335,201 and 4,347,308, British Patent 1,417,915, JP-A-55-149938, JP-A-58-196544 and British Pat. No. 1,439,402. Specific examples of these materials are indicated below.

F-1

$$C_8F_{17}SO_3K$$

F-2

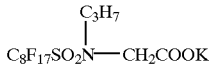

F-3

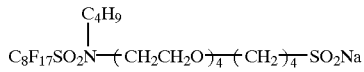

F-4

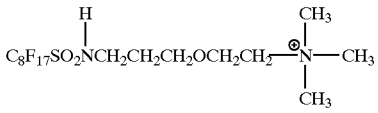

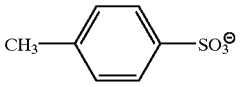

F-5

$$C_8F_{17}SO_3Li$$

No limitation is imposed upon the layer to which the fluorine-containing surfactant is added provided that it is included in at least one layer of the image-recording material, and it can be included, for example, in the surface protecting layer, emulsion layer, intermediate layer, undercoat layer or back layer. It is, however, preferably added to the surface protective layer, and while it may be added to one of the protective layers on the image-forming layer side and the back layer side, it is further preferably added to at least the protective layer on the image-forming layer side.

When the surface protective layer is composed of two or more layers, the fluorine-containing surfactant can be added to any of these layers, or it may be used in the form of an overcoat over the surface protective layer.

The amount of fluorine-containing surfactant used in this invention may be from 0.0001 to 1 g, preferably from 0.0002 to 0.25 g, particularly desirably from 0.0003 to 0.1 g, per 1 m$^2$ of the image-recording material.

Furthermore, two or more of the fluorine-containing surfactants can be mixed together.

Beck smoothness in the present invention can be easily determined by Japanese Industrial Standard (JIS) P8119, "Test Method for Smoothness of Paper and Paperboard by Beck Test Device" and TAPPI Standard Method T479.

Beck smoothness of at least one, or preferably both of the outermost layers of the image-forming layer side and the opposite side of the heat-developable image-recording material according to the present invention is 2000 seconds or less, preferably from 10 seconds to 2000 seconds.

Beck smoothness of the outermost layers of the image-forming layer side and the opposite side of the heat-developable image-recording material according to the present invention can be controlled by changing an average particle diameter and an addition amount of microparticles called matting agent incorporated into the outermost layers on the both sides. The matting agent is preferably contained in the outermost layer of the protective layer remotest from the support for the side of the image-forming layer, and in a layer of the back layer which is not the outermost layer for the opposite side.

The average particle diameter of the matting agent in the present invention is preferably in the range of from 1 to 10 $\mu$m.

The amount of the matting agent added in the present invention is preferably in the range of from 5 to 400 mg/m$^2$, particularly in the range of from 10 to 200 mg/m$^2$.

The matting agent used in the present invention may be any solid particles so long as they do not adversely affect various photographic properties. Inorganic matting agents include silicon dioxide, titanium and aluminum oxides, zinc and calcium carbonates, barium and calcium sulfates, calcium and aluminum silicates and the like, and organic matting agents include cellulose esters, organic polymer matting agents such as those of polymethyl methacrylate, polystyrene or polydivinylbenzene, copolymers thereof and the like.

In the present invention, it is preferred to use a porous matting agent described in JP-A-3-109542, page 2, lower left column, line 8 to page 3, upper right column, line 4, a matting agent in which the surface thereof has been modified with an alkali described in JP-A-4-127142, page 3, upper right column, line 7 to page 5, lower right column, line 4, or a matting agent of an organic polymer described in JP-A-6-118542, Paragraph Nos. [0005] to [0026].

Further, two or more kinds of these matting agents may be used in combination. For example, a combination of an inorganic matting agent and an organic matting agent, a combination of a porous matting agent and a non-porous matting agent, a combination of indefinite shape matting agent and a globular matting agent, a combination of matting agents having different average particle diameters (for example, a combination of a matting agent having an average particle diameter of 1.5 $\mu$m or more and a matting agent having an average particle diameter of 1 $\mu$m or less as described in JP-A-6-118542) can be used.

According to the present invention, the outermost layers on the image-forming layer side and/or the opposite side preferably contain a lubricant.

No particular limitation is imposed upon the lubricant used in the present invention, and any compound which, when present at the surface of an object, reduces the friction coefficient of the surface relative to that when the compound is absent can be used for this purpose.

Typical examples of the lubricant which can be used in the present invention include the silicone based lubricants disclosed in U.S. Pat. No. 3,042,522, British Patent No. 955,061, U.S. Pat. Nos. 3,080,317, 4,004,927, 4,047,958 and 3,489,567, British Patent No. 1,143,118 and the like, the higher fatty acid based, alcohol based and acid amide based lubricants disclosed in U.S. Pat. Nos. 2,454,043, 2,732,305, 2,976,148 and 3,206,311, German Patent Nos. 1,284,295, 1,284,294 and the like, the metal soaps disclosed in British Patent No. 1,263,722, U.S. Pat. No. 3,933,516 and the like, the ester based and ether based lubricants disclosed in U.S. Pat. Nos. 2,588,765, 3,121,060, British Patent No. 1,198,387, the taurine based lubricants disclosed in U.S. Pat. Nos. 3,502,473 and 3,042,222 and the like.

Specific examples of the lubricant preferably used include, CELLOSOL 524 (main ingredient is carnauba wax), POLYLON A, 393, H -481 (main ingredient is polyethylene wax), HIMICRON G-110 (main ingredient is ethylene bis-stearic acid amide), HIMICRON G -270 (main ingredient is stearic acid amide) (all from Chukyo Oil & Fat Co., Ltd.).

The amount of the lubricant used is 0.1–50% by weight, preferably 0.5–30% by weight of binder contained in a layer to which the lubricant is added.

The light-sensitive silver halide for use in the present invention may be any of silver chloride, silver chlorobromide, and silver iodochlorobromide. The halogen composition distribution within the grain may be uniform, or the halogen composition may be changed stepwise or continuously.

The method of forming light-sensitive silver halide used for the present invention is well known in the art and, for example, the methods described in *Research Disclosure*, No. 17029 (June, 1978) and U.S. Pat. No. 3,700,458 may be used. Specifically, a method comprising converting a part of silver in the produced organic silver salt to light-sensitive silver halide by adding a halogen-containing compound to the organic silver salt, or a method comprising adding a silver-supplying compound and a halogen-supplying compound to gelatin or other polymer solution to thereby prepare light-sensitive silver halide and mixing the silver halide with an organic silver salt may be used for the present invention. The light-sensitive silver halide grain preferably has a small grain size so as to prevent high white turbidity after the formation of an image. Specifically, the grain size is preferably 0.20 $\mu$m or less, more preferably from 0.01 to 0.15 $\mu$m, still more preferably from 0.02 to 0.12 $\mu$m. The term"grain size" as used herein means the length of an ridge of the silver halide grain in the case where the silver halide grain is a regular crystal such as cubic or octahedral grain; the diameter of a circle image having the same area as the projected area of the main surface plane in the case where the silver halide grain is a tabular silver halide grain; or the diameter of a sphere having the same volume as the silver halide grain in the case of other irregular crystals such as spherical or bar grain.

Examples of the shape of the silver halide grain include cubic form, octahedral form, tabular form, spherical form, stick form and bebble form, and among these, cubic grain and tabular grain are preferred in the present invention. When a tabular silver halide grain is used, the average aspect ratio is preferably from 100:1 to 2:1, more preferably from 50:1 to 3:1. A silver halide grain having rounded corners is also preferably used. The face index (Miller indices) of the outer surface plane of a light-sensitive silver halide grain is not particularly limited; however, it is preferred that [100] faces capable of giving a high spectral sensitization efficiency upon adsorption of the spectral sensitizing dye occupy a high ratio. The ratio is preferably 50% or more, more preferably 65% or more, still more preferably 80% or more. The ratio of [100] faces according to the Miller indices can be determined by the method described in T. Tani, *J. Imaging Sci.*, 29, 165 (1985) using the adsorption dependency of [111] face and [100] face upon adsorption of the sensitizing dye.

The light-sensitive silver halide grain for use in the present invention contains a metal or metal complex of Group VII or VIII in the Periodic Table. The center metal of the metal or metal complex of Group VII or VIII of the Periodic Table is preferably rhodium, rhenium, ruthenium, osnium or iridium. One kind of metal complex may be used or two or more kinds of complexes of the same metal or different metals may also be used in combination. The metal complex content is preferably from $1\times10^{-9}$ to $1\times10^{-2}$ mol, more preferably from $1\times10^{-8}$ to $1\times10^{-4}$ mol, per mol of silver. With respect to the specific structure of the metal complex, the metal complexes having the structures described in JP-A-7-225449 may be used.

As the rhodium compound for use in the present invention, a water-soluble rhodium compound may be used. Examples thereof include a rhodium(III) halogenide compounds and rhodium complex salts having a halogen, an amine or an oxalate as a ligand, such as hexachlororhodium (III) complex salt, pentachloroaquorhodium(III) complex salt, tetrachlorodiaquorhodium(III) complex salt, hexabromorhodium(III) complex salt, hexaamminerhodium (III) complex salt and trioxalatorhodium(III) complex salt. The rhodium compound is used after dissolving it in water or an appropriate solvent and a method commonly used for stabilizing the rhodium compound solution, that is, a method comprising adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble rhodium, separate silver halide grains previously doped with rhodium may be added and dissolved at the time of preparation of silver halide.

The amount of the rhodium compound added is preferably from $1\times10^{-8}$ to $5\times10^{-6}$ mol, more preferably from $5\times10^{-8}$ to $1\times10^{-6}$ mol, per mol of silver halide.

The rhodium compound may be appropriately added at the time of production of silver halide emulsion grains or at respective stages before coating of the emulsion. However, the rhodium compound is preferably added at the time of formation of the emulsion and integrated into the silver halide grain.

The rhenium, ruthenium or osmium for use in the present invention is added in the form of a water-soluble complex salt described in JP-A-63-2042, JP-A-1-285941, JP-A-2-20852 and JP-A-2-20855. A preferred example thereof is a six-coordinate complex salt represented by the following formula:

$$[ML_6]^{n-}$$

wherein M represents Ru, Re or Os, L represents a ligand, and n represents 0, 1, 2, 3 or 4. In this case, the counter ion plays no important role and an ammonium or alkali metal ion is used.

Preferred examples of the ligand include a halide ligand, a cyanide ligand, a cyan oxide ligand, a nitrosyl ligand and a thionitrosyl ligand. Specific examples of the complex for use in the present invention are shown below, but the present invention is by no means limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{-}$ | $[RUCl_5(H_2O)]^{2-}$ |
| $[RUCl_5(NO)]^{2-}$ | $[RuBr_5(NS)]^{2-}$ | |
| $[Ru(CO)_3Cl_3]^{2-}$ | $[Ru(CO)Cl_5]^{2-}$ | $[Ru(CO)Br_5]^{2-}$ |

-continued

| | | |
|---|---|---|
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(O)_2(CN)_4]^{4-}$ | |

The addition amount of these compound is preferably from $1\times10^{-9}$ to $1\times10^{-5}$ mol, more preferably from $1\times10^{-8}$ to $1\times10^{-6}$ mol, per mol of silver halide.

These compounds may be added appropriately at the time of preparation of silver halide emulsion grains or at respective stages before coating of the emulsion, but the compounds are preferably added at the time of formation of the emulsion and integrated into a silver halide grain.

For adding the compound during the grain formation of silver halide and integrating it into a silver halide grain, a method where a metal complex powder or an aqueous solution having dissolved therein the metal complex together with NaCl or KCl is added to a water-soluble salt or water-soluble halide solution during the grain formation, a method where the compound is added as the third solution at the time of simultaneously mixing a silver salt and a halide solution to prepare silver halide grains by the triple jet method, or a method where a necessary amount of an aqueous metal complex solution is poured into a reaction vessel during the grain formation, may be used. Among these, preferred is a method comprising adding a metal complex powder or an aqueous solution having dissolved therein the metal complex together with NaCl or KCl to a water-soluble halide solution.

In order to add the compound to the grain surface, a necessary amount of an aqueous metal complex solution may be charged into a reaction vessel immediately after the grain formation, during or after completion of the physical ripening, or at the time of chemical ripening.

As the iridium compound for use in the present invention, various compounds may be used, and examples thereof include hexachloroiridium, hexammineiridium, trioxalatoiridium, hexacyanoiridium and pentachlorohitrosyliridium. The iridium compound is used after dissolving it in water or an appropriate solvent, and a method commonly used for stabilizing the iridium compound solution, more specifically, a method comprising adding an aqueous solution of hydrogen halogenide (e.g., hydrochloric acid, bromic acid, fluoric acid) or halogenated alkali (e.g., KCl, NaCl, KBr, NaBr) may be used. In place of using a water-soluble iridium, separate silver halide grains previously doped with iridium may be added and dissolved at the time of preparation of silver halide.

The silver halide grain for use in the present invention may further contain a metal atom such as cobalt, iron, nickel, chromium, palladium, platinum, gold, thallium, copper and lead. In the case of cobalt, iron, chromium or ruthenium compound, a hexacyano metal complex is preferably used. Specific examples thereof include ferricyanate ion, ferrocyanate ion, hexacyanocobaltate ion, hexacyanochromate ion and hexacyanoruthenate ion. However, the present invention is by no means limited thereto. The phase of the silver halide, in which the metal complex is contained, is not particularly limited, and the phase may be uniform or the metal complex may be contained in a higher concentration in the core part or in the shell part.

The above-described metal is used preferably in an amount of from $1\times10^{-9}$ to $1\times10^{-4}$ mol per mol of silver halide. The metal may be converted into a metal salt in the form of a simple salt, a composite salt or a complex salt and added at the time of preparation of grains.

The light-sensitive silver halide grain may be desalted by water washing according to a method known in the art, such as noodle washing and flocculation, but the grain may not be desalted in the present invention.

The silver halide emulsion for use in the present invention is preferably subjected to chemical sensitization. The chemical sensitization may be performed using a known method such as sulfur sensitization, selenium sensitization, tellurium sensitization or noble metal sensitization. These sensitization method may be used alone or in any combination. When these sensitization methods are used as a combination, a combination of sulfur sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization, for example, are preferred.

The sulfur sensitization preferably used in the present invention is usually performed by adding a sulfur sensitizer and stirring the emulsion at a high temperature of 40° C. or higher for a predetermined time. The sulfur sensitizer may be a known compound and examples thereof include, in addition to the sulfur compound contained in gelatin, various sulfur compounds such as thiosulfates, thioureas, thiazoles and rhodanines. Preferred sulfur compounds are a thiosulfate and a thiourea compound. The amount of the sulfur sensitizer added varies depending upon various conditions such as the pH and the temperature at the chemical ripening and the size of silver halide grain. However, it is preferably from $10^{-7}$ to $10^{-2}$ mol, more preferably from $10^{-5}$ to $10^{-3}$ mol, per mol of silver halide.

The selenium sensitizer for use in the present invention may be a known selenium compound. The selenium sensitization is usually performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, JP-A-4-25832, JP-A-4-109240 and JP-A-4-324855. Among these, particularly preferred are the compounds represented by formulae (VIII) and (IX) of JP-A-4-324855.

The tellurium sensitizer for use in the present invention is a compound of forming silver telluride presumed to work out to a sensitization nucleus, on the surface or in the inside of a silver halide grain. The rate of the formation of silver telluride in a silver halide emulsion can be examined according to a method described in JP-A-5-313284. Examples of the tellurium sensitizer include diacyl tellurides, bis (oxycarbonyl) tellurides, bis(carbamoyl) tellurides, diacyl tellurides, bis(oxycarbonyl) ditellurides, bis(carbamoyl) ditellurides, compounds having a P═Te bond, tellurocarboxylates, Te-organyltellurocarboxylic acid esters, di(poly)tellurides, tellurides, tellurols, telluroacetals, tellurosulfonates, compounds having a P-Te bond, Te-containing heterocyclic rings, tellurocarbonyl compounds, inorganic tellurium compounds and colloidal tellurium. Specific examples thereof include the compounds described in U.S. Pat. Nos. 1,623,499, 3,320,069 and 3,772,031, British Patent Nos. 235,211, 1,121,496, 1,295,462 and 1,396,696, Canadian Patent No. 800,958, JP-A-4-204640, JP-A-3-53693, JP-A-4-271341, JP-A-4-333043, JP-A-5-303157, *J. Chem. Soc. Chem. Commun.*, 635 (1980), ibid., 1102 (1979), ibid., 645 (1979), J. Chem. Soc. *Perkin. Trans.*, 1, 2191 (1980), S. Patai (compiler), *The Chemistry of Organic Selenium and Tellurium Compounds*, Vol. 1 (1986), and ibid., Vol. 2 (1987). The compounds represented by formulae (II), (III) and (IV) of JP-A-5-313284 are particularly preferred.

The amount of the selenium or tellurium sensitizer used in the present invention varies depending on silver halide grains used or chemical ripening conditions. However, it is usually from $10^{-8}$ to $10^{-2}$ mol, preferably on the order of from $10^{-7}$ to $10^{-3}$ mol, per mol of silver halide. The conditions for chemical sensitization in the present invention are not particularly restricted. However, in general, the pH is from 5 to 8, the pAg is from 6 to 11, preferably from 7 to 10, and the temperature is from 40 to 95° C., preferably from 45 to 85° C.

Noble metal sensitizers for use in the present invention include gold, platinum, palladium and iridium, and particularly, gold sensitization is preferred. Examples of the gold sensitizers used in the present invention include chloroauric acid, potassium chloroaurate, potassium aurithiocyanate and gold sulfide. They can be used in an amount of about $10^{-7}$ mol to about $10^{-2}$ mol per mol of silver halide.

In the silver halide emulsion for use in the present invention, a cadmium salt, sulfite, lead salt or thallium salt may be allowed to be present together during formation or physical ripening of silver halide grains.

In the present invention, reduction sensitization may be used. Specific examples of the compound used in the reduction sensitization include an ascorbic acid, thiourea dioxide, stannous chloride, aminoiminomethanesulfinic acid, a hydrazine derivative, a borane compound, a silane compound and a polyamine compound. The reduction sensitization may be performed by ripening the grains while keeping the emulsion at a pH of 7 or more or at a pAg of 8.3 or less. Also, the reduction sensitization may be performed by introducing a single addition part of silver ion during the formation of grains.

To the silver halide emulsion of the present invention, a thiosulfonic acid compound may be added by the method described in European Patent 293917A.

In the heat-developable image-forming material of the present invention, one kind of silver halide emulsion may be used or two or more kinds of silver halide emulsions (for example, those different in the average grain size, different in the halogen composition, different in the crystal habit or different in the chemical sensitization conditions) may be used in combination.

The amount of the light-sensitive silver halide used in the present invention is preferably from 0.01 to 0.5 mol, more preferably from 0.02 to 0.3 mol, still more preferably from 0.03 to 0.25 mol, per mol of the organic silver salt. The method and conditions for mixing light-sensitive silver halide and organic silver salt which are prepared separately are not particularly limited as far as the effect of the present invention can be brought out satisfactorily. However, a method of mixing the silver halide grains and the organic silver salt after completion of respective preparations in a high-speed stirring machine, a ball mill, a sand mill, a colloid mill, a vibrating mill or a homogenizer or the like, or a method involving preparing organic silver salt while mixing therewith light-sensitive silver halide after completion of the preparation in any timing during preparation of the organic silver salt, or the like may be used.

As a method for producing silver halides used for the present invention, the so-called halidation can also be preferably used, in which a part of silver of organic silver salts is halogenated with organic or inorganic halide. While the organic halide compound used for this method is not particularly limited so long as it can react with organic silver salt to form a silver halide, examples thereof include, for example, N-halogenoimides (N-bromosuccinimide etc.), halogenated quaternary nitrogen compounds (tetrabutylammonium bromide etc.), halogenated quaternary nitrogen compounds associated with halogen (pyridinium bromide perbromide etc.) and the like. As for the inorganic halide compound, while it is not particularly limited so long as it can react with organic silver salt to form a silver halide, examples thereof include, for example, alkali metal halides or ammonium halides (e.g., sodium chloride, lithium bromide, potassium iodide, ammonium bromide), alkali earth metal halides (e.g., calcium bromide, magnesium chloride), transition metal halides (ferric chloride, cupric bromide etc.), metal complexes having halogen ligands (sodium bromoiridate, ammonium chlororhodate etc.), halogen atoms (bromine, chlorine, iodine etc.) and the like. The organic and inorganic halides can be used in a desired combination.

The amount of the halide compounds when the halidation is used for the present invention is preferably 1 mM to 500 mM, more preferably 10 mM to 250 mM in terms of halogen atom per 1 mol of the organic silver salt.

The organic silver salt which can be used in the present invention is a silver salt which is relatively stable against light but forms a silver image when it is heated at 80° C. or higher in the presence of an exposed photocatalyst (e.g., a latent image of light-sensitive silver halide) and a reducing agent. The organic silver salt may be any organic substance containing a source capable of reducing the silver ion. A silver salt of an organic acid, particularly a silver salt of a long chained aliphatic carboxylic acid (having from 10 to 30, preferably from 15 to 28 carbon atoms) is preferred. A complex of an organic or inorganic silver salt, of which ligand has a complex stability constant of from 4.0 to 10.0, is also preferred. The silver-supplying substance may constitute preferably from about 5 to 70% by weight of the image-forming layer. The preferred organic silver salt includes a silver salt of an organic compound having a carboxyl group. Examples thereof include an aliphatic carboxylic acid silver salt and an aromatic carboxylic acid silver salt. However, the present invention is by no means limited thereto. Preferred examples of the aliphatic carboxylic acid silver salt include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and a mixture thereof.

Silver salts of compounds having a mercapto or thione group and derivatives thereof may also be used as the organic silver salt. Preferred examples of these compounds include a silver salt of 3-mercapto-4-phenyl-1,2,4-triazole, silver salt of 2-mercaptobenzimidazole, silver salt of 2-mercapto-5-aminothiadiazole, silver salt of 2-(ethylglycolamido)benzothiazole, silver salts of thioglycolic acids such as silver salts of S-alkylthioglycolic acids wherein the alkyl group has 12 to 22 carbon atoms, silver salts of dithiocarboxylic acids such as silver salt of dithioacetic acid, silver salts of thioamides, silver salt of 5-carboxyl-1-methyl-2-phenyl-4-thiopyridine, silver salts of mercaptotriazines, silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thione compounds such as silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Patent Nos. 4,761,361 and 4,775,613.

The shape of the organic silver salt which can be used in the present invention is not particularly limited but an acicular crystal form having a short axis and a long axis is preferred. In the present invention, the short axis is preferably from 0.01 to 0.20 $\mu$m, more preferably from 0.01 to 0.15 $\mu$m, and the long axis is preferably from 0.10 to 5.0 $\mu$m, more preferably from 0.10 to 4.0 $\mu$m. The grain size distribution of the organic silver salt is preferably monodisperse. The term "monodisperse" as used herein means that the percentage of the value obtained by dividing the standard deviation of the length of the short axis or long axis by the length of the short axis or long axis, respectively, is preferably 100% or less, more preferably 80% or less, still more preferably 50% or less. The shape of the organic silver salt can be determined by the image of an organic silver salt dispersion observed through a transmission type electron microscope. Another method for determining the monodispesibility is a method involving obtaining the standard deviation of a volume load average diameter of the organic silver salt. The percentage (coefficient of variation) of the value obtained by dividing the standard deviation by the volume load average diameter is preferably 100% or less, more preferably 80% or less, still more preferably 50% or less. The grain size (volume load average diameter) for determining the monodispersibility may be obtained, for example, by irradiating a laser ray on an organic silver salt dispersed in a solution and determining an autocorrelation function of the fluctuation of the scattered light to the change in time.

The organic silver salt which can be used in the present invention is preferably desalted. The desalting method is not particularly limited and a known method may be used. Known filtration methods such as centrifugal filtration, suction filtration, ultrafiltration and flocculation washing by coagulation may be preferably used.

The organic silver salt that can be used for the present invention is converted into a dispersion of solid microparticles using a dispersant in order to obtain coagulation-free microparticles of a small size. The organic silver salt can be mechanically made into a dispersion of solid microparticles by using a known means for producing microparticles (for example, ball mill, vibrating ball mill, planet ball mill, sand mill, colloid mill, jet mill, roller mill, high pressure homogenizer) in the presence of a dispersing aid.

When the organic silver salt is made into microparticles by using a dispersant, the dispersant can be suitably selected from, for example, synthetic anionic polymers such as polyacrylic acid, copolymers of acrylic acid, maleic acid copolymers, maleic acid monoester copolymers and acryloylmethylpropanesulfonic acid copolymers, semisynthetic anionic polymers such as carboxymethylated starch and carboxymethylcellulose, anionic polymers such as alginic acid and pectic acid, anionic surfactants such as those disclosed in JP-A-52-92716, WO88/04794 and the like, compounds disclosed in JP-A-9-179243, known anionic, nonionic and cationic surfactants, other known polymers such as polyvinyl alcohol, polyvinylpyrrolidone, carboxymethylcellulose, hydroxypropylcellulose, and hydroxypropylmethylcellulose, naturally occurring polymers such as gelatin and the like.

The dispersing aid is generally mixed with the organic silver salt in a form of powder or wet cake before the dispersing operation, and fed as slurry into a dispersing apparatus. However, it may be mixed with the organic silver salt beforehand, and subjected to a treatment by heating, with solvent or the like to form organic silver salt powder or wet cake. The pH may be controlled with a suitable pH modifier during or after the dispersing operation.

Other than the dispersing operation by a mechanical means, the organic silver salt can be made into microparticles by roughly dispersing it in a solvent through pH control, and then changing the pH in the presence of a dispersant. For this operation, an organic solvent may be used as the solvent for roughly dispersing the organic silver salt, and such an organic solvent is usually removed after the formation of microparticles.

The produced dispersion can be stored with stirring in order to prevent precipitation of the microparticles during storage, or stored in a highly viscous state formed with a hydrophilic colloids (e.g., a jelly state formed with gelatin). Further, it may be added with a preservative in order to prevent saprophytic proliferation during the storage.

While the organic silver salt can be used for the present invention at any desired amount, it is preferably used in an amount of 0.1–5 g/m$^2$, more preferably 1–3 g/m$^2$ per square meter of the heat-developable image-recording material.

The heat-developable image-recording material of the present invention contains a reducing agent for organic silver salt. The reducing agent for organic silver salt may be any substance, preferably an organic substance, which reduces the silver ion to metal silver. Conventional photographic developers such as phenidone, hydroquinone and catechol are useful, but a hindered phenol reducing agent is preferred. The reducing agent is preferably contained in an amount of from 5 to 50% by mol, more preferably from 10 to 40% by mol, per mol of silver on the surface having an image-forming layer. The layer to which the reducing agent is added may be any layer on the surface having an image-forming layer. In the case of adding the reducing agent to a layer other than the image-forming layer, the reducing agent is preferably used in a slightly large amount of from 10 to 50% by mol per mol of silver. The reducing agent may also be a so-called precursor which is derived to effectively exhibit the function only at the time of development.

For the heat-developable light-sensitive material using an organic silver salt, reducing agents over a wide range are known and these are disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,9586, 3,679,426, 3,751,252, 3,751,255, 3,761,270, 3,782,949, 3,839,048, 3,928,686 and 5,464,738, German Patent No.2,321,328, European Patent 692732 and the like. Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid such as a combination of 2,2-bis(hydroxymethyl)propionyl-β-phenylhydrazine with an ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2-dihydroxy-1,1-binaphthyl, 6,6-dibromo-2,2-dihydroxy-1,1-binaphthyl and bis(2-hydroxy-1-naphthyl)methane; combinations of a bis-β-naphthol with a 1,3-dihydroxybenzene derivative (e.g., 2,4-dihydroxybenzophenone, 2,4-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethylhexane and 2,2-bis (3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols such as tocopherol. Particularly preferred reducing agents are bisphenols and chromanols.

The reducing agent of the present invention may be added in any form of a solution, powder and a solid microparticle dispersion. The solid microparticle dispersion is performed using a known pulverizing means (e.g., ball mill, vibrating ball mill, sand mill, colloid mill, jet mill, roller mill). At the time of solid microparticle dispersion, a dispersion aid may also be used.

When an additive known as a "color toner" capable of improving the image is added, the optical density increases in some cases. Also, the color toner is advantageous in forming a black silver image depending on the case. The color toner is preferably contained on the surface having an image-forming layer in an amount of from 0.1 to 50% by mol, more preferably from 0.5 to 20% by mol, per mol of silver. The color toner may be a so-called precursor which is derived to effectively exhibit the function only at the time of development.

For the heat-developable light-sensitive material using an organic silver salt, color toners over a wide range are known and these are disclosed in JP-A-46-6077, JP-A-47-10282, JP-A-49-5019, JP-A-49-5020, JP-A-49-91215, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent No. 1,380,795 and Belgian Patent No. 841910. Examples of the color toner include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-

(dimethylaminomethyl)naphthalene-2,3-dicarboxyimide; blocked pyrazoles, isothiuronium derivatives and a certain kind of photobleaching agents, such as N,N'-hexamethylenebis(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride); phthalazine, phthalazine derivatives (e.g., 4-(1-naphthyl)phthalazine, 6-chlorophthalazinone, 5,7-dimethoxyphthalazine, 2,3-dihydrophthalazine) and metal salts thereof; combinations of a phthalazine and a phthalic acid derivative (e.g., phthalic acid, 4-methylphthalic acid, 4-nitrophthalic acid, tetrachlorophthalic acid anhydride), quinazolinedione, benzoxazine and naphthoxazine derivatives; rhodium complexes which function not only as a color toner but also as a halide ion source for the formation of silver halide at the site, such as ammonium hexachlororhodate(III), rhodium bromide, rhodium nitrate and potassium hexachlororhodate(III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione, and 6-nitro-1,2-benzoxazin-2,4-dione; pyrimidines and asymmetric triazines such as 2,4-dihydroxpyrimidine and 2-hydroxy-4-aminopyrimidine; and azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene.

The color toner of the present invention may be added in any form of a solution, powder, solid microparticle dispersion and the like. The solid fine particle dispersion is performed using a known pulverization means (e.g., ball mill, vibrating ball mill, sand mill, colloid mill, jet mill, roller mill). At the time of solid microparticle dispersion, a dispersion aid may also be used.

The heat-developable image-recording material of the present invention preferably contains an ultrahigh contrast agent, preferably in the image-forming layer and/or another layer adjacent thereto so as to obtain a high-contrast image. Preferred examples of the ultrahigh contrast agent for use in the present invention include substituted alkene derivatives represented by the formula (1), substituted isooxazole derivatives represented by the formula (2), specific acetal compounds represented by the formula (3) and hydrazine derivatives.

The substituted alkene derivatives represented by the formula (1), substituted isooxazole derivatives represented by the formula (2), specific acetal compounds represented by the formula (3) for use in the present invention will be explained below.

(1)

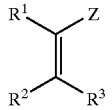

-continued (2)

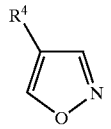

(3)

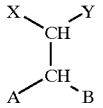

In the general formula (1), $R^1$, $R^2$ and $R^3$ each independently represents a hydrogen atom or a substituent, Z represents an electron withdrawing group or a silyl group, and $R^1$ and Z, $R^2$ and $R^3$, $R^1$ and $R^2$, or $R^3$ and Z may be combined with each other to form a ring structure; in the formula (2), $R_4$ represents a substituent; and in the formula (3), X and Y each independently represents a hydrogen atom or a substituent, A and B each independently represents an alkoxy group, an alkylthio group, an alkylamino group, an aryloxy group, an arylthio group, an anilino group, a heterocyclic oxy group, a heterocyclic thio group or a heterocyclic amino group, and X and Y, or A and B may be combined with each other to form a ring structure.

The compound represented by the formula (1) is described in detail below.

In the formula (1), $R^1$, $R^2$ and $R^3$ each independently represents a hydrogen atom or a substituent, and Z represents an electron withdrawing group or a silyl group. In the formula (1), $R^1$ and Z, $R^2$ and $R^3$, $R^1$ and $R^2$, or $R^3$ and Z may be combined with each other to form a ring structure.

When $R^1$, $R^2$ or $R^3$ represents a substituent, examples of the substituent include a halogen atom (e.g., fluorine, chlorine, bromide, iodine), an alkyl group (including an aralkyl group, a cycloalkyl group and active methine group), an alkenyl group, an alkynyl group, an aryl group, a heterocyclic group (including N-substituted nitrogen-containing heterocyclic group), a quaternized nitrogen-containing heterocyclic group (e.g., pyridinio group), an acyl group, an alkoxycarbonyl group, an aryloxycarbonyl group, a carbamoyl group, a carboxy group or a salt thereof, an imino group, an imino group substituted by N atom, a thiocarbonyl group, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group (or a salt thereof), an alkoxy group (including a group containing an ethyleneoxy group or propyleneoxy group repeating unit), an aryloxy group, a heterocyclic oxy group, an acyloxy group, an (alkoxy or aryloxy) carbonyloxy group, a carbamoyloxy group, a sulfonyloxy group, an amino group, an (alkyl, aryl or heterocyclic)amino group, an acylamino group, a sulfonamido group, a ureido group, a thioureido group, an imido group, an (alkoxy or aryloxy)carbonylamino group, a sulfamoylamino group, a semicarbazide group, a thiosemicarbazide group, a hydrazino group, a quaternary ammonio group, an oxamoylamino group, an (alkyl or aryl) sulfonylureido group, an acylureido group, an acylsulfamoylamino group, a nitro group, a mercapto group or a salt thereof, an (alkyl, aryl or heterocyclic)thio group, an acylthio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, a phosphoryl group, a group containing phosphoramide or phosphoric acid ester structure, a silyl group and a stannyl group.

These substituents each may further be substituted by any of the above-described substituents.

The electron withdrawing group represented by Z in the formula (1) is a substituent having a Hammett's substituent constant σp of a positive value, and specific examples thereof include a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a halogen atom, a perfluoroalkyl group, a perfluoroalkanamido group, a sulfonamido group, an acyl group, a formyl group, a phosphoryl group, a carboxy group (or a salt thereof), a sulfo group (or a salt thereof), a heterocyclic group, an alkenyl group, an alkynyl group, an acyloxy group, an acylthio group, a sulfonyloxy group and an aryl group substituted by the above-described electron withdrawing group. The heterocyclic group is a saturated or unsaturated heterocyclic group and examples thereof include a pyridyl group, a quinolyl group, a pyrazinyl group, a quinoxalinyl group, a benzotriazolyl group, an imidazolyl group, a benzimidazolyl group, a hydantoin-1-yl group, a succinimido group and a phthalimido group.

The electron withdrawing group represented by Z in the formula (1) may further have a substituent and examples of the substituent include those described for the substituent which the substituent represented by $R^1$, $R^2$ or $R^3$ in the formula (1) may have.

In the formula (1), $R^1$ and Z, $R^2$ and $R^3$, $R^1$ and $R^2$, or $R^3$ and Z may be combined with each other to form a ring structure. The ring structure formed is a non-aromatic carbocyclic ring or a non-aromatic heterocyclic ring.

The preferred range of the compound represented by the formula (1) is described below.

The silyl group represented by Z in the formula (1) is preferably a trimethylsilyl group, a t-butyldimethylsilyl group, a phenyldimethylsilyl group, a triethylsilyl group, a triisopropylsilyl group or a trimethylsilyldimethylsilyl group.

The electron withdrawing group represented by Z in the formula (1) is preferably a group having a total carbon atom number of from 0 to 30 such as a cyano group, an alkoxycarbonyl group, an aryloxycarbonyl group, a carbamoyl group, a thiocarbonyl group, an imino group, an imino group substituted by N atom, a sulfamoyl group, an alkylsulfonyl group, an arylsulfonyl group, a nitro group, a perfluoroalkyl group, an acyl group, a formyl group, a phosphoryl group, an acyloxy group, an acylthio group or a phenyl group substituted by any electron withdrawing group, more preferably a cyano group, an alkoxycarbonyl group, a carbamoyl group, an imino group, a sulfamoyl group, an alkylsulfonyl group, an arylsulfonyl group, an acyl group, a formyl group, a phosphoryl group, a trifluoromethyl group or a phenyl group substituted by any electron withdrawing group, still more preferably a cyano group, a formyl group, an acyl group, an alkoxycarbonyl group, an imino group or a carbamoyl group.

The group represented by Z in the formula (1) is preferably an electron withdrawing group.

The substituent represented by $R^1$, $R^2$ or $R^3$ in the formula (1) is preferably a group having a total carbon atom number of from 0 to 30 and specific examples of the group include a group having the same meaning as the electron withdrawing group represented by Z in the formula (1), an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an arylamino group, a heterocyclic amino group, a ureido group, an acylamino group, a sulfonamido group and a substituted or unsubstituted aryl group.

In the formula (1), $R^1$ is preferably an electron withdrawing group, an aryl group, an alkylthio group, an alkoxy group, an acylamino group, a hydrogen atom or a silyl group.

When $R^1$ represents an electron withdrawing group, the electron withdrawing group is preferably a group having a total carbon atom number of from 0 to 30 such as a cyano group, a nitro group, an acyl group, a formyl group, an alkoxycarbonyl group, an aryloxycarbonyl group, a thiocarbonyl group, an imino group, an imino group substituted by N atom, an alkylsulfonyl group, an arylsulfonyl group, a carbamoyl group, a sulfamoyl group, a trifluoromethyl group, a phosphoryl group, a carboxy group (or a salt thereof), a saturated or unsaturated heterocyclic group, more preferably a cyano group, an acyl group, a formyl group, an alkoxycarbonyl group, a carbamoyl group, an imino group, an imino group substituted by N atom, a sulfamoyl group, a carboxy group (or a salt thereof) or a saturated or unsaturated heterocyclic group, still more preferably a cyano group, a formyl group, an acyl group, an alkoxycarbonyl group, a carbamoyl group or a saturated or unsaturated heterocyclic group.

When $R^1$ represents an aryl group, the aryl group is preferably a substituted or unsubstituted phenyl group having a total carbon atom number of from 6 to 30. The substituent may be any substituent but an electron withdrawing substituent is preferred.

In the formula (1), $R^1$ is more preferably an electron withdrawing group or an aryl group.

The substituent represented by $R^2$ or $R^3$ in the formula (1) is preferably a group having the same meaning as the electron withdrawing group represented by Z in the formula (1), an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group or a substituted or unsubstituted phenyl group.

In the formula (1), it is more preferred that one of $R^2$ and $R^3$ is a hydrogen atom and the other is a substituent. The substituent is preferably an alkyl group, a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group, an acylamino group (particularly, a perfluoroalkanamido group), a sulfonamido group, a substituted or unsubstituted phenyl group or a heterocyclic group, more preferably a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group, still more preferably a hydroxy group (or a salt thereof), an alkoxy group or a heterocyclic group.

In the formula (1), it is also preferred that Z and $R^1$ or $R^2$ and $R^3$ form a ring structure. The ring structure formed is a non-aromatic carbocyclic ring or a non-aromatic heterocyclic ring, preferably a 5-, 6- or 7-membered ring structure having a total carbon atom number including those of substituents of from 1 to 40, more preferably from 3 to 30.

The compound represented by the formula (1) is more preferably a compound where Z represents a cyano group, a formyl group, an acyl group, an alkoxycarbonyl group, an imino group or a carbamoyl group, $R^1$ represents an electron withdrawing group or an aryl group, and one of $R^2$ and $R^3$ represents a hydrogen atom and the other represents a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group, more preferably a compound where Z and $R^1$ form a non-aromatic 5-, 6-or 7-membered ring structure and one of $R^2$ and $R^3$ represents a hydrogen atom and the other represents a hydroxy group (or a salt thereof), a mercapto group (or a salt thereof), an alkoxy group, an aryloxy group, a heterocyclic oxy group, an alkylthio group, an arylthio group, a heterocyclic thio group or a heterocyclic group. At this time, Z which forms a non-aromatic ring structure together with $R^1$ is preferably an acyl group, a carbamoyl group, an oxycarbonyl group, a thiocarbonyl group or a sulfonyl group and $R^1$ is preferably an acyl group, a carbamoyl group, an oxycarbonyl group, a thiocarbonyl group, a sulfonyl group, an imino group, an imino group substituted by N atom, an acylamino group or a carbonylthio group.

The compound represented by the formula (2) is described below.

In the formula (2), $R^4$ represents a substituent. Examples of the substituent represented by $R^4$ include those described for the substituent represented by $R^1$, $R^2$ or $R^3$ in the formula (1).

The substituent represented by $R^1$ is preferably an electron withdrawing group or an aryl group. When $R^4$ represents an electron withdrawing group, the electron withdrawing group is preferably a group having a total carbon atom number of from 0 to 30 such as a cyano group, a nitro group, an acyl group, a formyl group, an alkoxycarbonyl group, an aryloxycarbonyl group, an alkylsulfonyl group, an arylsulfonyl group, a carbamoyl group, a sulfamoyl group, a trifluoromethyl group, a phosphoryl group, an imino group or a saturated or unsaturated heterocyclic group, more preferably a cyano group, an acyl group, a formyl group, an alkoxycarbonyl group, a carbamoyl group, a sulfamoyl group, an alkylsulfonyl group, an arylsulfonyl group or a heterocyclic group, still more preferably a cyano group, a formyl group, an acyl group, an alkoxycarbonyl group, a carbamoyl group or a heterocyclic group.

When $R^4$ represents an aryl group, the aryl group is preferably a substituted or unsubstituted phenyl group having a total carbon atom number of from 0 to 30. Examples of the substituent include those described for the substituent represented by $R^1$, $R^2$ or $R^3$ in the formula (1).

$R^4$ is more preferably a cyano group, an alkoxycarbonyl group, a carbamoyl group, a heterocyclic group or a substituted or unsubstituted phenyl group, most preferably a cyano group, a heterocyclic group or an alkoxycarbonyl group.

The compound represented by the formula (3) is described in detail below.

In the formula (3), X and Y each independently represents a hydrogen atom or a substituent, and A and B each independently represents an alkoxy group, an alkylthio group, an alkylamino group, an aryloxy group, an arylthio group, an anilino group, a heterocyclic thio group, a heterocyclic oxy group or a heterocyclic amino group, and X and Y or A and B may be combined with each other to form a ring structure.

Examples of the substituent represented by X or Y in the formula (3) include those described for the substituent represented by $R^1$, $R^2$ or $R^3$ in the formula (1). Specific examples thereof include an alkyl group (including a perfluoroalkyl group and a trichloromethyl group), an aryl group, a heterocyclic group, a halogen atom, a cyano group, a nitro group, an alkenyl group, an alkynyl group, an acyl group, a formyl group, an alkoxycarbonyl group, an aryloxycarbonyl group, an imino group, an imino group substituted by N atom, a carbamoyl group, a thiocarbonyl group, an acyloxy group, an acylthio group, an acylamino group, an alkylsulfonyl group, an arylsulfonyl group, a sulfamoyl group, a phosphoryl group, a carboxy group (or a salt thereof), a sulfo group (or a salt thereof), a hydroxy group (or a salt thereof), a mercapto group (or a salt thereof), an alkoxy group, an aryloxy group, a heterocyclic oxy group, an alkylthio group, an arylthio group, a heterocyclic thio group, an amino group, an alkylamino group, an anilino group, a heterocyclic amino group and a silyl group.

These groups each may further have a substituent. X and Y may be combined with each other to form a ring structure and the ring structure formed may be either a non-aromatic carbocyclic ring or a non-aromatic heterocyclic ring.

In the formula (3), the substituent represented by X or Y is preferably a substituent having a total carbon number of from 1 to 40, more preferably from 1 to 30, such as a cyano group, an alkoxycarbonyl group, an aryloxycarbonyl group, a carbamoyl group, an imino group, an imino group substituted by N atom, a thiocarbonyl group, a sulfamoyl group, an alkylsulfonyl group, an arylsulfonyl group, a nitro group, a perfluoroalkyl group, an acyl group, a formyl group, a phosphoryl group, an acylamino group, an acyloxy group, an acylthio group, a heterocyclic group, an alkylthio group, an alkoxy group or an aryl group.

In the formula (3), x and Y each is more preferably a cyano group, a nitro group, an alkoxycarbonyl group, a carbamoyl group, an acyl group, a formyl group, an acylthio group, an acylamino group, a thiocarbonyl group, a sulfamoyl group, an alkylsulfonyl group, an arylsulfonyl group, an imino group, an imino group substituted by N atom, a phosphoryl group, a trifluoromethyl group, a heterocyclic group or a substituted phenyl group, still more preferably a cyano group, an alkoxycarbonyl group, a carbamoyl group, an alkylsulfonyl group, an arylsulfonyl group, an acyl group, an acylthio group, an acylamino group, a thiocarbonyl group, a formyl group, an amino group, an imino group substituted by N atom, a heterocyclic group or a phenyl group substituted by any electron withdrawing group.

X and Y are also preferably combined with each other to form a non-aromatic carbocyclic ring or a non-aromatic heterocyclic ring. The ring structure formed is preferably a 5-, 6- or 7-membered ring having a total carbon atom number of from 1 to 40, more preferably from 3 to 30. X and Y for forming a ring structure each is preferably an acyl group, a carbamoyl group, an oxycarbonyl group, a thiocarbonyl group, a sulfonyl group, an imino group, an imino group substituted by N atom, an acylamino group or a carbonylthio group.

In the formula (3), A and B each independently represents an alkoxy group, an alkylthio group, an alkylamino group, an aryloxy group, an arylthio group, an anilino group, a heterocyclic thio group, a heterocyclic oxy group or a heterocyclic amino group, which may be combined with each other to form a ring structure. Those represented by A and B in the formula (3) are preferably a group having a total carbon atom number of from 1 to 40, more preferably from 1 to 30, and the group may further have a substituent.

In the formula (3), A and B are more preferably combined with each other to form a ring structure. The ring structure formed is preferably a 5-, 6- or 7-membered non-aromatic heterocyclic ring having a total carbon atom number of from 1 to 40, more preferably from 3 to 30. Examples of the linked structure (—A—B—) formed by A and B include —O—$(CH_2)_2$—O—, —O—$(CH_2)_3$—O—, —S—$(CH_2)_2$—S—, —S—$(CH_2)_3$—S—, —S-ph-S—, —N($CH_3$)—$(CH_2)_2$—O—, —N($CH_3$)—$(CH_2)_2$—S—, —O—$(CH_2)_2$—S—, —O—$(CH_2)_3$—S—, —N($CH_3$)-ph-O—, —N($CH_3$)-ph-S— and —N(ph)—$(CH_2)_2$—S—.

Into the compound represented by the formula (1), (2) or (3) for use in the present invention, an adsorptive group capable of adsorbing to silver halide may be integrated. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamide group, a mercaptoheterocyclic group and a triazole group. The adsorptive group to silver halide may be formed into a precursor. Examples of the precursor include the groups described in JP-A-2-285344.

Into the compound represented by the formula (1), (2) or (3) for use in the present invention, a ballast group or polymer commonly used in immobile photographic additives such as a coupler may be integrated, preferably a ballast group is incorporated. The ballast group is a group having 8 or more carbon atoms and being relatively inactive to the photographic properties. Examples of the ballast group include an alkyl group, an aralkyl group, an alkoxy group, a phenyl group, an alkylphenyl group, a phenoxy group and an alkylphenoxy group. Examples of the polymer include those described in JP-A-1-100530.

The compound represented by the formula (1), (2) or (3) for use in the present invention may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic) thio group, or a dissociative group capable of dissociation by a base (e.g., carboxy group, sulfo group, acylsulfamoyl group, carbamoylsulfamoyl group), preferably a group containing an ethyleneoxy group or a propyleneoxy group as a repeating unit, or an (alkyl, aryl or heterocyclic)thio group. Specific examples of these groups include the compounds described in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

Specific examples of the compounds represented by the formulae (1) to (3) for use in the present invention are shown below. However, the present invention is by no means limited to the following compounds.

C-1

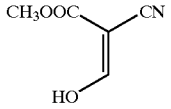

C-2

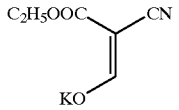

-continued

C-3

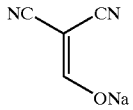

C-4

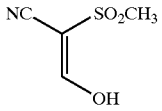

C-5

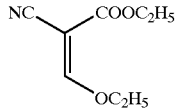

C-6

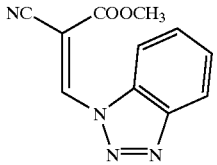

C-7

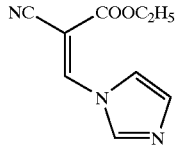

C-8

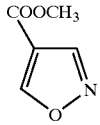

C-9

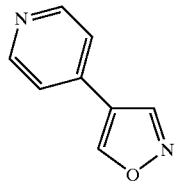

C-10

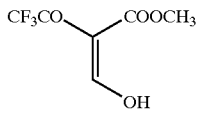

C-11

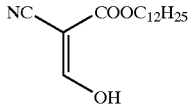

C-12

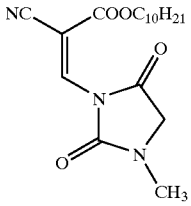

-continued
C-13
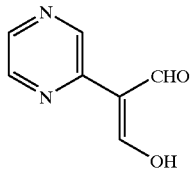
C-14
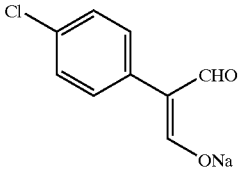
C-15
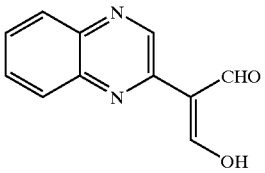
C-16
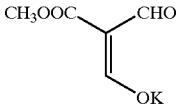
C-17
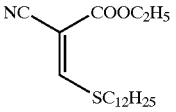
C-18
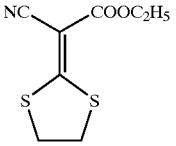
C-19
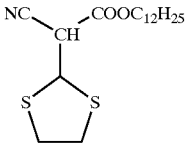
C-20
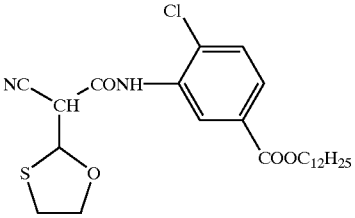
C-21
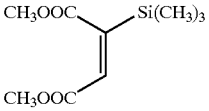
C-22
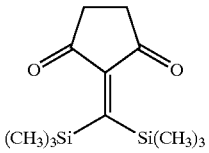
-continued
C-23
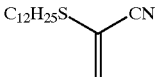
C-24
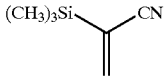
C-25
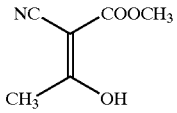
C-26
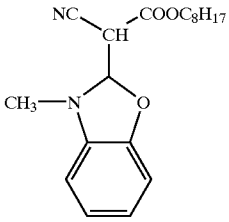
C-27
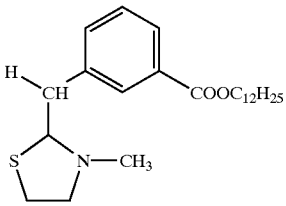
C-28
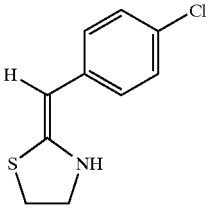
C-29
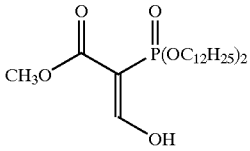
C-30
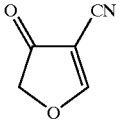
C-31
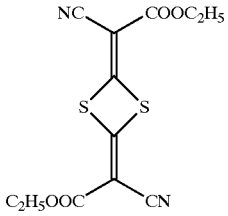

-continued
C-32
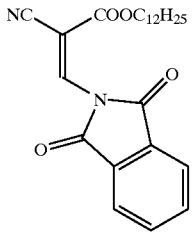
C-33
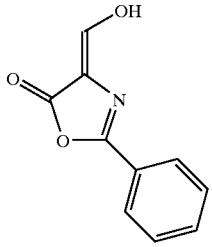
C-34
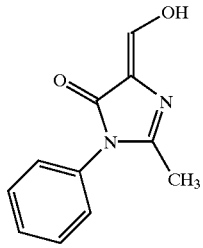
C-35
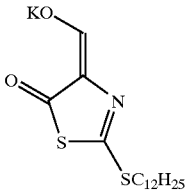
C-36
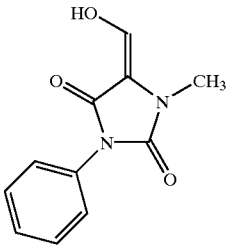
C-37
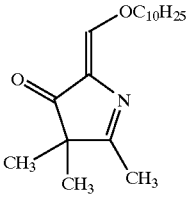
-continued
C-38
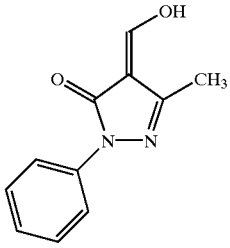
C-39
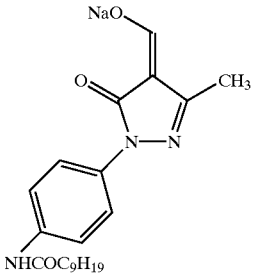
C-40
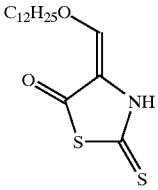
C-41
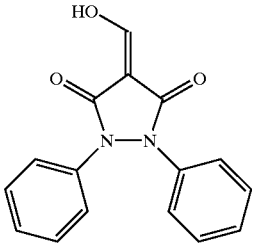
C-42
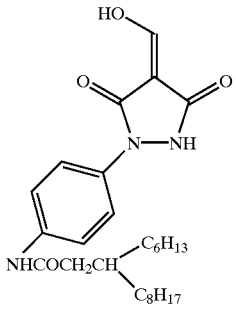

-continued
C-43
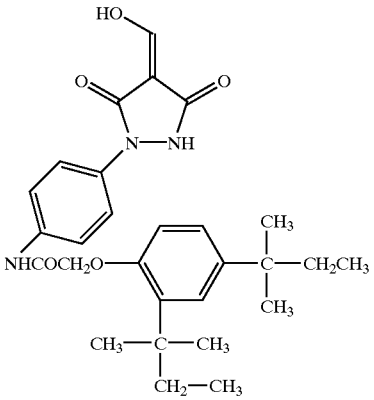
C-44
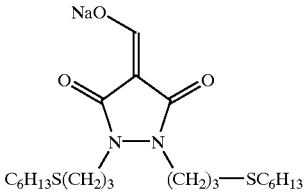
C-45
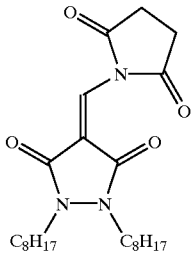
C-46
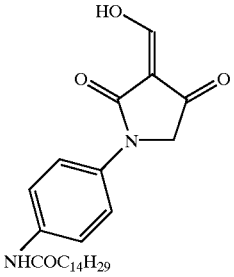
C-47
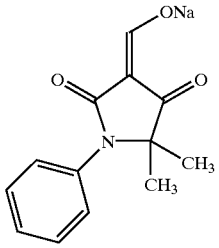
-continued
C-48
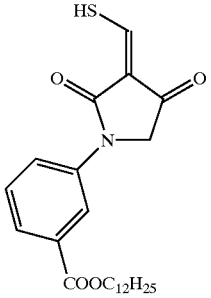
C-49
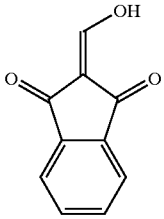
C-50
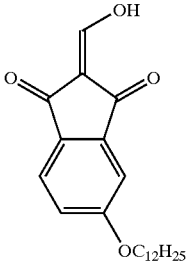
C-51
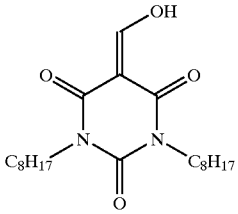
C-52
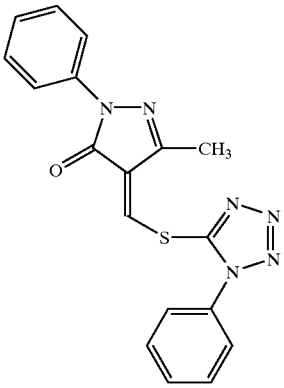
C-53
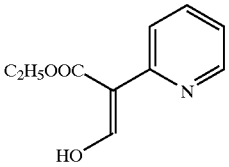

-continued

C-54

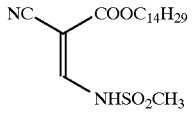

C-55

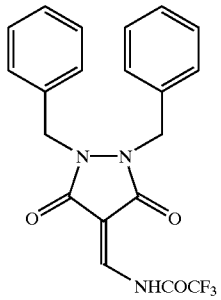

C-56

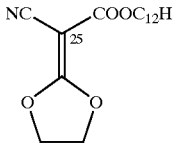

C-57

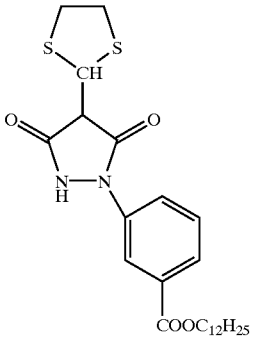

C-58

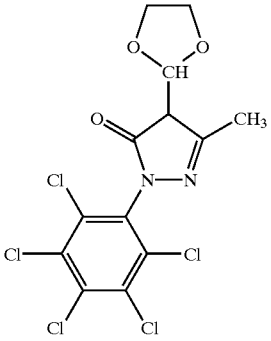

-continued

C-59

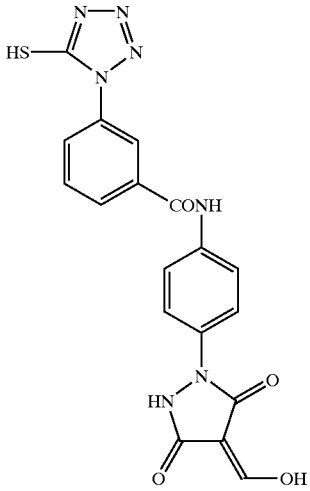

C-60

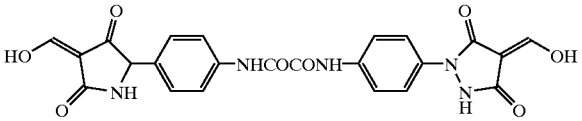

The compounds represented by the formulae (1) to (3) for use in the present invention each may be used after dissolving it in water or an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the compounds represented by the formulae (1) to (3) for use in the present invention each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, the compounds represented by the formulae (1) to (3) each may be used after dispersing the powder of the compound in an appropriate solvent such as water by a method known as a solid dispersion method, using a ball mill, a colloid mill or an ultrasonic wave.

The compounds represented by the formulae (1) to (3) for use in the present invention each may be added to a layer in the image-recording layer side on the support, namely, an image-forming layer, or any other layers; however, the compounds each is preferably added to an image-forming layer or a layer adjacent thereto.

The addition amount of the compound represented by the formula (1), (2) or (3) for use in the present invention is preferably from $1\times10^{-6}$ to 1 mol, more preferably from $1\times10^{-5}$ to $5\times10^{-1}$ mol, most preferably from $2\times10^{-5}$ to $2\times10^{-1}$ mol, per mol of silver.

The compounds represented by formulae (1) to (3) can be easily synthesized according to known methods and may be synthesized by referring, for example, to U.S. Pat. Nos. 5,545,515, 5,635,339 and 5,654,130, International Patent Publication WO97/34196 or Japanese Patent Application Nos. 9-354107, 9-309813 and 9-272002.

The compounds represented by the formulae (1) to (3) may be used individually or in combination of two or more thereof. In addition to these compounds, a compound described in U.S. Pat. Nos. 5,545,515, 5,635,339 and 5,654,130, International Patent Publication WO97/34196, U.S. Pat. No. 5,686,228 or Japanese Patent Application Nos. 8-279962, 9-228881, 9-273935, 9-354107, 9-309813, 9-296174, 9-282564, 9-272002, 9-272003 and 9-332388 may also be used in combination. They can also be used in combination with such hydrazine derivatives as mentioned below.

The hydrazine derivative for use in the present invention as an ultrahigh contrast agent is preferably a compound represented by the following general formula (H):

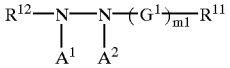

(H)

In the formula, $R^{12}$ represents an aliphatic group, an aromatic group or a heterocyclic group, $R^{11}$ represents a hydrogen atom or a block group, $G^1$ represents —CO—, —COCO—, —C(=S)—, —$SO^2$—, —SO—, —PO($R^{13}$)— (wherein $R^{13}$ is a group selected from the groups within the range defined for $R^{11}$, and $R^3$ may be different from $R^{11}$), or an iminomethylene group, $A^1$ and $A^2$ both represents a hydrogen atom or one represents a hydrogen atom and the other represents a substituted or unsubstituted alkylsulfonyl group, a substituted or unsubstituted arylsulfonyl group, or a substituted or unsubstituted acyl group, and $m^1$ represents 0 or 1 and when $m^1$ is 0, $R^{11}$ represents an aliphatic group, an aromatic group or a heterocyclic group.

In the formula (H), the aliphatic group represented by $R^{12}$ is preferably a substituted or unsubstituted, linear, branched or cyclic alkyl group, an alkenyl group or an alkynyl group having from 1 to 30 carbon atoms.

In the formula (H), the aromatic group represented by $R^{12}$ is a monocyclic or condensed cyclic aryl group, and examples thereof include a phenyl group and a naphthalene group. The heterocyclic group represented by $R^{12}$ is a monocyclic or condensed cyclic, saturated or unsaturated, aromatic or non-aromatic heterocyclic group, and examples thereof include a pyridine ring, a pyrimidine ring, an imidazole ring, a pyrazole ring, a quinoline ring, an isoquinoline ring, a benzimidazole ring, a thiazole ring, a benzothiazole ring, a piperidine ring, a triazine ring, a morpholino ring, a piperidine ring and a piperazine ring.

$R^{12}$ is preferably an aryl group or an alkyl group.

$R^{12}$ may be substituted and representative examples of the substituent include a halogen atom (e.g., fluorine, chlorine, bromine, iodine), an alkyl group (including an aralkyl group, a cycloalkyl group and an active methine group), an alkenyl group, an alkynyl group, an aryl group, a heterocyclic group, a heterocyclic group containing a quaternized nitrogen atom (e.g., pyridinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group containing an ethyleneoxy group or a propylene oxy group repeating unit), an aryloxy group, a heterocyclic oxy group, an acyloxy group, an (alkoxy or aryloxy)carbonyloxy group, a carbamoyloxy group, a sulfonyloxy group, an amino group, an (alkyl, aryl or heterocyclic) amino group, a N-substituted nitrogen-containing heterocyclic group, an acylamino group, a sulfonamido group, a ureido group, a thioureido group, an imido group, an (alkoxy or aryloxy)carbonylamino group, a sulfamoylamino group, a semicarbazide group, thiosemicarbazide group, a hydrazino group, a quaternary ammonio group, an oxamoylamino group, an (alkyl or aryl) sulfonylureido group, an acylureido group, an acylsulfamoylamino group, a nitro group, a mercapto group, an (alkyl, aryl or heterocyclic)thio group, an (alkyl or aryl) sulfonyl group, an (alkyl or aryl)sulfinyl group, a sulfo group or a salt thereof, a sulfamoyl group, an acylsulfamoyl group, a sulfonylsulfamoyl group or a salt thereof, and a group containing a phosphoramido or phosphoric acid ester structure.

These substituents each may further be substituted by any of the above-described substituents.

When $R^{12}$ represents an aromatic group or a heterocyclic group, the substituent of $R^{12}$ is preferably an alkyl group (including an active methylene group), an aralkyl group, a heterocyclic group, a substituted amino group, an acylamino group, a sulfonamido group, a ureido group, a sulfamoylamino group, an imido group, a thioureido group, aphosphoramido group, a hydroxy group, an alkoxy group, an aryloxy group, an acyloxy group, an acyl group, an alkoxycarbonyl group, an aryloxycarbonyl group, a carbamoyl group, a carboxy group (including a salt thereof), an (alkyl, aryl orheterocyclic) thio group, a sulfo group (including a salt thereof), a sulfamoyl group, a halogen atom, a cyano group or a nitro group.

When $R^{12}$ represents an aliphatic group, the substituent is preferably an alkyl group, an aryl group, a heterocyclic group, an amino group, an acylamino group, a sulfonamido group, a ureido group, a sulfamoylamino group, an imido group, a thioureido group, a phosphoramido group, a hydroxy group, an alkoxy group, an aryloxy group, an acyloxy group, an acyl group, an alkoxycarbonyl group, an aryloxycarbonyl group, a carbamoyl group, a carboxy group (including a salt thereof), an (alkyl, aryl or heterocyclic) thio group, a sulfo group (including a salt thereof), a sulfamoyl group, a halogen atom, a cyano group or a nitro group.

In the formula (H), $R^{11}$ represents a hydrogen atom or a block group. The block group is specifically an aliphatic group (specifically, an alkyl group, an alkenyl group or an alkynyl group), an aromatic group (e.g., a monocyclic or condensed cyclic aryl group), a heterocyclic group, an alkoxy group, an aryloxy group, an amino group or a hydrazino group.

The alkyl group represented by $R^{11}$ is preferably a substituted or unsubstituted alkyl group having from 1 to 10 carbon atoms, and examples thereof include a methyl group, an ethyl group, a trifluoromethyl group, a difluoromethyl group, a 2-carboxytetrafluoroethyl group, a pyridiniomethyl group, a difluoromethoxymethyl group, a difluorocarboxymethyl group, a 3-hydroxypropyl group, a 3-methanesulfonamidopropyl group, a phenylsulfonylmethyl group, an o-hydroxybenzyl group, a methoxymethyl group, a phenoxymethyl group, a 4-ethylphenoxymethyl group, a phenylthiomethyl group, a t-butyl group, a dicyanomethyl group, a diphenylmethyl group, a triphenylmethyl group, a methoxycarbonyldiphenylmethyl group, a cyanodiphenylmethyl group and a methylthiodiphenylmethyl group. The alkenyl group is preferably an alkenyl group having from 1 to 10 carbon atoms, and examples thereof include a vinyl group, a 2-ethoxycarbonylvinyl group and a 2-trifluoro-2-methoxycarbonylvinyl group. The alkynyl group is an alkynyl group having from 1 to 10 carbon atoms, and examples thereof include an ethynyl group and a 2-methoxycarbonylethynyl group. The aryl group is preferably a monocyclic or condensed cyclic aryl group, more preferably an aryl group containing a benzene ring, and examples thereof include a phenyl group, a perfluorophenyl group, a 3,5-dichlorophenyl group, a 2-methanesulfonamidophenyl group, a 2-carbamoylphenyl group, a 4,5-dicyanophenyl group, a 2-hydroxymethylphenyl group, 2,6-dichloro-4-cyanophenyl group and 2-chloro-5-octylsulfamoylphenyl group.

The heterocyclic group is preferably a 5- or 6-membered, saturated or unsaturated, monocyclic or condensed heterocyclic group containing at least one nitrogen, oxygen or sulfur atom, and examples thereof include a morpholino group, a piperidino group (N-substituted), an imidazolyl group, an indazolyl group (e.g., 4-nitroindazolyl group), a pyrazolyl group, a triazolyl group, a benzoimidazolyl group, a tetrazolyl group, a pyridyl group, a pyridinio group (e.g., N-methyl-3-pyridinio group), a quinolinio group and a quinolyl group.

The alkoxy group is preferably an alkoxy group having from 1 to 8 carbon atoms, and examples thereof include a methoxy group, a 2-hydroxyethoxy group, a benzyloxy group and a t-butoxy group. The aryloxy group is preferably a substituted or unsubstituted phenoxy group, and the amino group is preferably an unsubstituted amino group, an alkylamino group having from 1 to 10 carbon atoms, an arylamino group or a saturated or unsaturated heterocyclic amino group (including a nitrogen-containing heterocyclic amino group containing a quaternized nitrogen atom). Examples of the amino group include 2,2,6,6-tetramethylpiperidin-4-ylamino group, a propylamino group, a 2-hydroxyethylamino group, an anilino group, an o-hydroxyanilino group, a 5-benzotriazolylamino group and a N-benzyl-3-pyridinioamino group. The hydrazino group is preferably a substituted or unsubstituted hydrazino group or a substituted or unsubstituted phenylhydrazino group (e.g., 4-benzenesulfonamidophenylhydrazino group).

The group represented by $R^{11}$ may be substituted, and examples of the substituent include those described as the substituent of $R^{12}$.

In the formula (H), $R^{11}$ may be one which cleaves the $G^1$—$R^{11}$ moiety from the residual molecule and causes a cyclization reaction to form a cyclic structure containing the atoms in the —$G^1$—$R^{11}$ moiety, and examples thereof include those described in JP-A-63-29751.

Into the hydrazine derivative represented by the formula (H), an adsorptive group capable of adsorbing to silver halide may be integrated. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamide group, a mercaptoheterocyclic group and a triazole group. The adsorptive group to silver halide may be formed into a precursor. Examples of the precursor include the groups described in JP-A-2-285344.

In the formula (H), $R^{11}$ or $R^{12}$ may be one into which a ballast group or polymer commonly used in immobile photographic additives such as a coupler maybe integrated. The ballast group is a group having 8 or more carbon atoms and being relatively inactive to the photographic properties. Examples of the ballast group include an alkyl group, an aralkyl group, an alkoxy group, a phenyl group, an alkylphenyl group, a phenoxy group and an alkylphenoxy group. Examples of the polymer include those described in JP-A-1-100530.

In the formula (H), $R^1$ or $R^2$ may contain a plurality of hydrazino groups as the substituent. At this time, the compound represented by the formula (H) is a polymer product with respect to the hydrazino group, and specific examples thereof include the compounds described in JP-A-64-86134, JP-A-4-16938, JP-A-5-197091, W095-32452, W095-32453, Japanese Patent Application Nos. 7-351132, 7-351269, 7-351168, 7-351287 and 9-351279.

In the formula (H), $R^{11}$ or $R^{12}$ may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclic) thio group, or a dissociative group capable of dissociation by a base (e.g., carboxy group, sulfo group, acylsulfamoyl group, carbamoylsulfamoyl group). Examples of the compound containing such a group include the compounds described in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

In the formula (H), $A^1$ and $A^2$ each represents a hydrogen atom, an alkyl- or arylsulfonyl group having 20 or less carbon atoms (preferably a phenylsulfonyl group or a phenylsulfonyl group substituted such that the sum of Hammett's substituent constants is −0. 5 or more), an acyl group having 20 or less carbon atoms (preferably a benzoyl group, a benzoyl group substituted such that the sum of Hammett's substituent constants is −0.5 or more, or a linear, branched or cyclic, substituted or unsubstituted aliphatic acyl group (examples of the substituent include a halogen atom, an ether group, a sulfonamido group, a carbonamido group, a hydroxy group, a carboxy group and a sulfo group)).

$A^1$ and $A^2$ each is most preferably a hydrogen atom.

A particularly preferred embodiment of the hydrazine derivative for use in the present invention is described below.

$R^{12}$ is preferably a phenyl group or a substituted alkyl group having from 1 to 3 carbon atoms.

When $R^{12}$ represents a phenyl group, the substituent therefor is preferably a nitro group, an alkoxy group, an alkyl group, an acylamino group, a ureido group, a sulfonamido group, a thioureido group, a carbamoyl group, a sulfamoyl group, a carboxy group (or a salt thereof), a sulfo group (or a salt thereof), an alkoxycarbonyl group or a chlorine atom.

When $R^{12}$ represents a substituted phenyl group, the substituent is preferably substituted directly or through a linking group by at least one of a ballast group, an adsorptive group to silver halide, a group containing a quaternary ammonio group, a nitrogen-containing heterocyclic group containing a quaternized nitrogen, a group containing an ethyleneoxy group as a repeating unit, an (alkyl, aryl or heterocyclic)thio group, a nitro group, an alkoxy group, an acylamino group, a sulfonamido group, a dissociative group (e.g., carboxy group, sulfo group, acylsulfamoyl group, carbamoylsulfamoyl group) and a hydrazino group capable of forming a polymer product (a group represented by -NHNH-$G^1$—$R^{11}$).

When $R^{12}$ represents a substituted alkyl group having from 1 to 3 carbon atoms, $R^{12}$ is more preferably a substituted methyl group, more preferably a disubstituted or trisubstituted methyl group, and the substituent therefor is preferably a methyl group, a phenyl group, a cyano group, an (alkyl, aryl or heterocyclic)thio group, an alkoxy group, an aryloxy group, a chlorine atom, a heterocyclic group, an alkoxycarbonyl group, an aryloxycarbonyl group, a carbamoyl group, a sulfamoyl group, an amino group, an acylamino group or a sulfonamido group, more preferably a substituted or unsubstituted phenyl group.

When $R^{12}$ represents a substituted methyl group, $R^{12}$ is preferably a t-butyl group, a dicyanomethyl group, a dicyanophenylmethyl group, a triphenylmethyl group (trityl group), a diphenylmethyl group, a methoxycarbonyldiphenylmethyl group, a cyanodiphenylmethyl group, a methylthiodiphenylmethyl group or a cyclopropyldiphenylmethyl group, most preferably a trityl group.

In the formula (H), $R^{12}$ is most preferably a substituted phenyl group.

In the formula (H), $m^1$ represents 1 or 0. When $m^1$ is 0, $R^{11}$ is an aliphatic group, an aromatic group or a heterocyclic group, preferably a phenyl group or a substituted alkyl group having from 1 to 3 carbon atoms, and these groups have the same preferred range as described above for $R^{12}$.

$m^1$ is preferably 1.

The preferred embodiment of the group represented by $R^{11}$ is described below. When $R^{12}$ is a phenyl group and $G^1$ is —CO— group, $R^{11}$ is preferably a hydrogen atom, an alkyl group, an alkenyl group, an alkynyl group, an aryl group or a heterocyclic group, more preferably a hydrogen atom, an alkyl group or an aryl group, and most preferably a hydrogen atom or an alkyl group. In the case where $R^{11}$ represents an alkyl group, the substituent therefor is preferably a halogen atom, an alkoxy group, an aryloxy group, an alkylthio group, an arylthio group or a carboxy group.

When $R^{12}$ is a substituted methyl group and $G^1$ is —CO— group, $R^{11}$ is preferably a hydrogen atom, an alkyl group, an aryl group, a heterocyclic group, an alkoxy group or an amino group (e.g., unsubstituted amino group, alkylamino group, arylamino group, heterocyclic amino group), more preferably a hydrogen atom, an alkyl group, an aryl group, a heterocyclic group, an alkoxy group, an alkylamino group, an arylamino group or a heterocyclic amino group. When $G^1$ is —COCO— group, $R^{11}$ is preferably, irrespective of $R^{12}$, an alkoxy group, an aryloxy group or an amino group, more preferably a substituted amino group, specifically, an alkylamino group, an arylamino group or a saturated or unsaturated heterocyclic amino group.

When $G^1$ is —$SO_2$— group, $R^{11}$ is preferably, irrespective of $R^{12}$, an alkyl group, an aryl group or a substituted amino group.

In the formula (H), $G^1$ is preferably —CO— or —COCO— group, more preferably —CO— group.

Specific examples of the compound represented by the formula (H) are shown below. However, the present invention is by no means limited to those compounds.

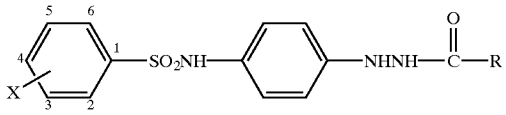
| | X = | R = —H | —$C_2F_4$—COOH or (—$C_2F_4$—$COO^{\ominus}K^{\oplus}$) | 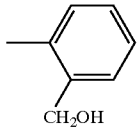 | 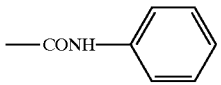 |
|---|---|---|---|---|---|
| 1 | 3-NHCO—$C_9H_{19}$(n) | 1a | 1b | 1c | 1d |
| 2 | 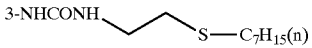 | 2a | 2b | 2c | 2d |
| 3 | 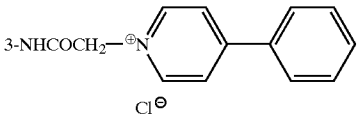 | 3a | 3b | 3c | 3d |
| 4 | 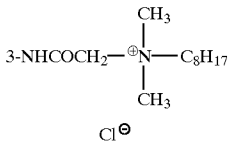 | 4a | 4b | 4c | 4d |
| 5 | 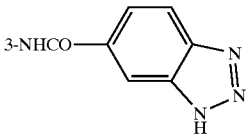 | 5a | 5b | 5c | 5d |
| 6 | 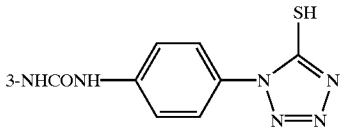 | 6a | 6b | 6c | 6d |
| 7 | 2,4-$(CH_3)_2$-3- | 7a | 7b | 7c | 7d |

-continued
| | $SC_2H_4$—$(OC_2H_4)_4$—$OC_8H_{17}$ | | | | |
|---|---|---|---|---|---|
| | 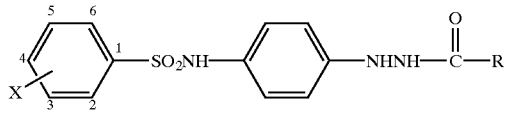 | | | | |
| | X = | R = —H | —$CF_2H$ | —$CH_2$—$^{\oplus}N$ (pyridinium, $Cl^{\ominus}$) | —CONH— (2,2,6,6-tetramethylpiperidyl, NH) |
| 8 | 3-$CONHCH_2CH(C_2H_5)$—$C_4H_9$ | 8a | 8e | 8f | 8g |
| 9 | 6-$OCH_3$-3-$C_5H_{11}$(t) | 9a | 9e | 9f | 9g |
| 10 | 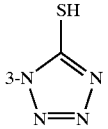 | 10a | 10e | 10f | 10g |
| 11 | 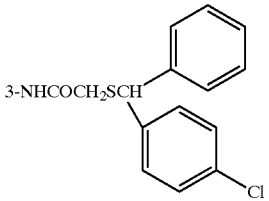 | 11a | 11e | 11f | 11g |
| 12 | 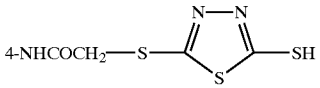 | 12a | 12e | 12f | 12g |
| 13 | 3-NHCOCH(CH$_2$COOH)—$C_8H_{17}$ | 13a | 13e | 13f | 13g |

-continued
| | | | | | |
|---|---|---|---|---|---|
| 14 | 3,5—(CONHCH$_2$CH(C$_2$H$_5$)—C$_4$H$_9$)$_2$ | 14a | 14e | 14f | 14g |
| | 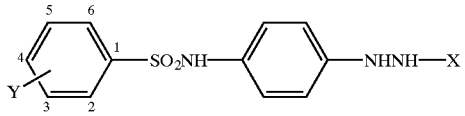 | | | | |
| | | X = | | | |
| | Y = | —CHO | —COCF$_3$ | —SO$_2$CH$_3$ | —P(=O)(OC$_2$H$_5$)$_2$ |
| 15 | 3-NHCOCH$_2$$^{\oplus}$N—CONHC$_4$H$_9$ $^{\ominus}$Cl• | 15a | 15h | 15i | 15j |
| 16 | 4-NHCO(CH$_2$)$_2$$^{\oplus}$N—C$_6$H$_{13}$ • Cl$^{\ominus}$ | 16a | 16h | 16i | 16j |
| 17 | 3-SO$_2$NH—(CH$_2$)$_3$—O—(CH$_2$)$_4$—OC$_4$H$_9$ | 17a | 17h | 17i | 17j |
| 18 | 3,4-(COOCH(CH$_3$)COOC$_4$H$_9$)$_2$ | 18a | 18h | 18i | 18j |
| 19 | 3-NHCO—(CH$_2$)$_4$— 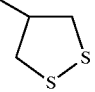 | 19a | 19h | 19i | 19j |
| 20 | 3-NHSO$_2$NH—C$_8$H$_{17}$ | 20a | 20h | 20i | 20j |

-continued
| | | | | | |
|---|---|---|---|---|---|
| 21 | 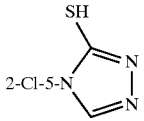 | 21a | 21h | 21i | 21j |
| | | R = | | | |
| | | —H | —$CF_3$ | 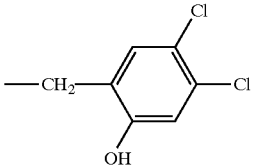 | 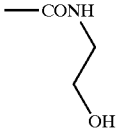 |
| 22 | 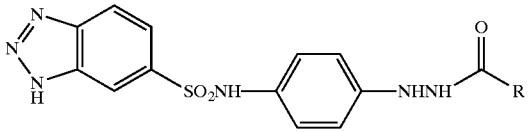 | 22a | 22h | 22k | 22l |
| 23 | 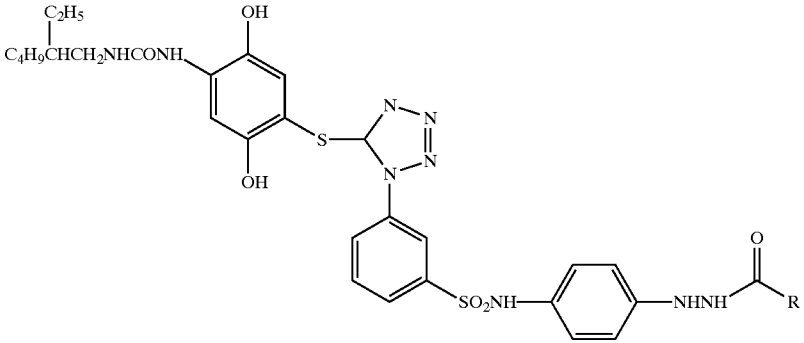 | 23a | 23h | 23k | 23l |

-continued
| | | | | | |
|---|---|---|---|---|---|
| 24 | 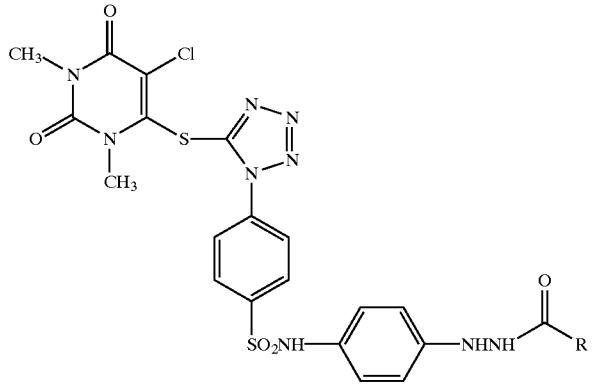 | 24a | 24h | 24k | 24l |
| 25 | 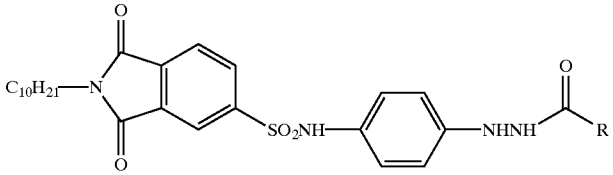 | 25a | 25h | 25k | 25l |
| 26 | 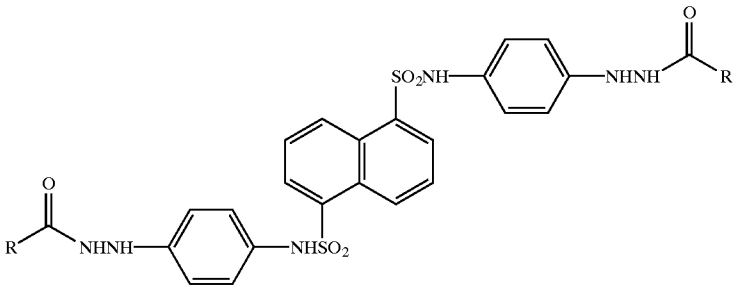 | 26a | 26h | 26k | 26l |

-continued
| | | | | | |
|---|---|---|---|---|---|
| 27 | 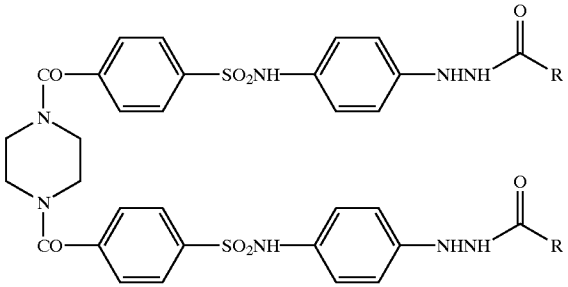 | 27a | 27h | 27k | 27l |
| 28 | 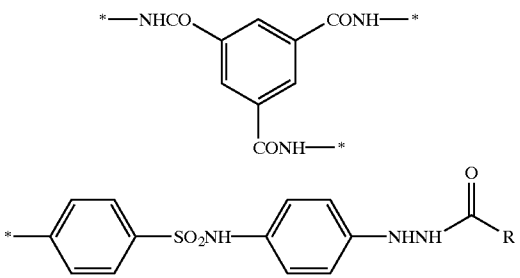 | 28a | 28h | 28k | 28l |
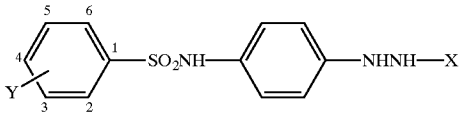
| Y = | R = —H | —$CH_2OCH_3$ | 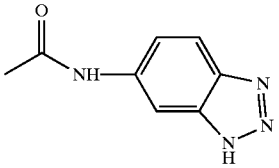 | 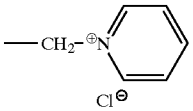 |
|---|---|---|---|---|
| 29 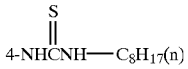 | 29a | 29m | 29n | 29f |

-continued
| | | | | | |
|---|---|---|---|---|---|
| 30 | 4-NHP(O)(OCH$_2$—C$_6$H$_4$)$_2$ | 30a | 30m | 30n | 30f |
| 31 | 4-NHCONH—(CH$_2$)$_3$O—C$_6$H$_4$—C(CH$_3$)$_3$ | 31a | 31m | 31n | 31f |
| 32 | 4-OH<br>3-NHCONHCH$_2$CH(C$_2$H$_5$)—C$_4$H$_9$ | 32a | 32m | 32n | 32f |
| 33 | 4-NHSO$_2$(CH$_2$)$_2$NHCO—C$_6$H$_4$— 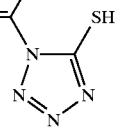 | 33a | 33m | 33n | 33f |
| 34 | 4-OCH$_2$—C$_6$H$_5$ | 34a | 34m | 34n | 34f |
| 35 | 4-NHCONHN(CH$_2$—C$_6$H$_5$)$_2$ | 35a | 35m | 35n | 35f |
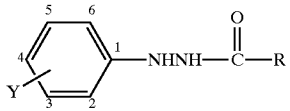
| Y = | R = —H | —CF$_2$SCH$_3$ | —CONHCH$_3$ | 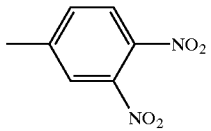 |
|---|---|---|---|---|

-continued

| | | | | | |
|---|---|---|---|---|---|
| 36 | 2-$NHSO_2CH_3$—<br>4-$NHCONH(CH_2)_3$— H | 36a | 36o | 36p | 36q |
| 37 | 2-$OCH_3$—<br>4-$NHSO_2C_{12}H_{25}$ | 37a | 37o | 37p | 37q |
| 38 | 3-$NHCOC_{11}H_{23}$—<br>4-$NHSO_2CF_3$ | 38a | 38o | 38p | 38q |
| 39 | O<br>4-N<br>$SO_2$<br>$CONHC_8H_{17}$ | 39a | 39o | 39p | 39q |
| 40 | 4-$OCO(CH_2)_2COOC_6H_{13}$ | 40a | 40o | 40p | 40q |
| 41 | SH<br>4-NHCONH— N<br>N<br>N<br>$CH_3$ | 41a | 41o | 41p | 41q |
| 42 | S SH<br>4-NHCO— N | 42a | 42o | 42p | 42q |
| 43 | O<br>$COCH_2^{\oplus}N$ — $SO_2NH$ — N — NHNH — $COOCH_3$<br>$CF_3$<br>$\cdot Cl^{\ominus}$ | | | | |

-continued
44
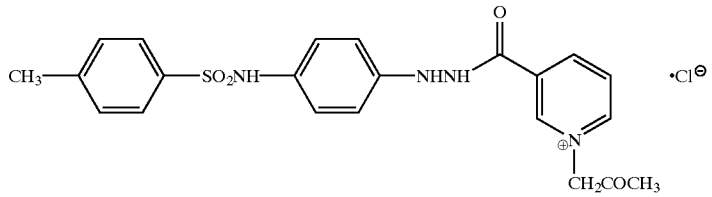
45
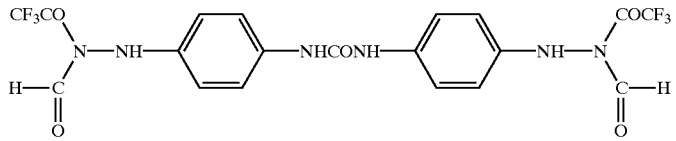
46
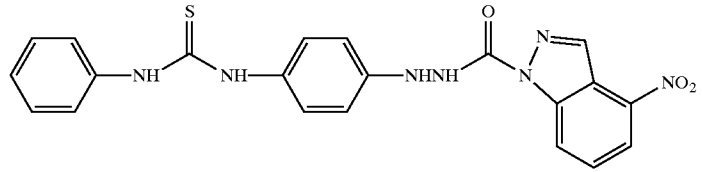
47
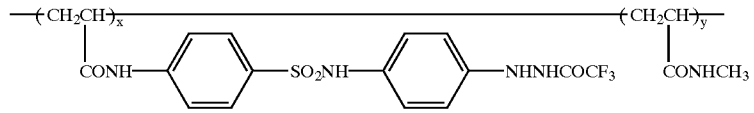
X:Y = 3:97
average molecular weight ≈ 10$\bar{7}$
48
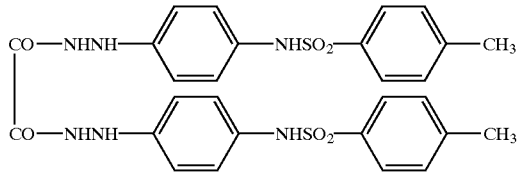

-continued
49
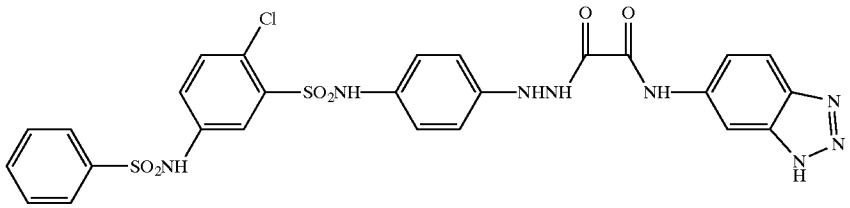
50
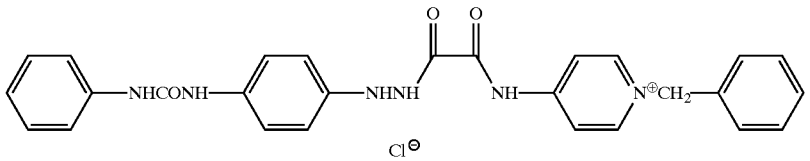
51
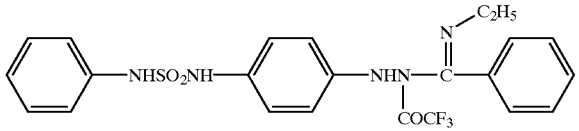
52
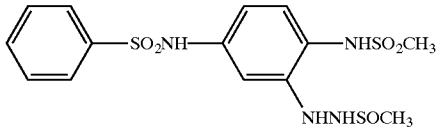
53
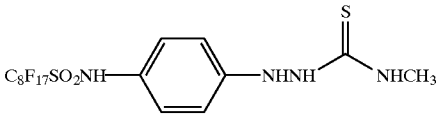
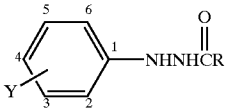
R =

-continued
| | Y = | —H | —$CH_2OCH_3$ | —$CH_2O$— 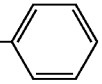 | —$CONHC_3H_7$ |
|---|---|---|---|---|---|
| 54 | 2-$OCH_3$ | 54a | 54m | 54r | 54s |
| 55 | 2-$OCH_3$ 5-$C_8H_{17}$(t) | 55a | 55m | 55r | 55s |
| 56 | 4-$NO_2$ | 56a | 56m | 56r | 56s |
| 57 | 4-$CH_3$ | 57a | 57m | 57r | 57s |
| 58 | 4-NHCO— 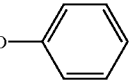 | 58a | 58m | 58r | 58s |
| 59 | 4-NHC(=O)N(—$CH_2$— 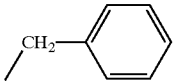 )(—$CH_2$— 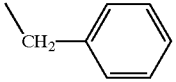 ) | 59a | 59m | 59r | 59s |
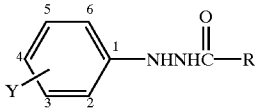
| | Y = | R = —H | 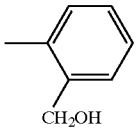 | 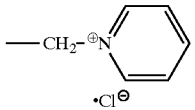 | 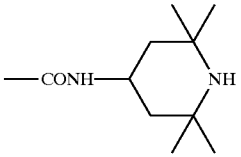 |
|---|---|---|---|---|---|
| 60 | 2-$OCH_3$ 5-$OCH_3$ | 60a | 60c | 60f | 60g |
| 61 | 4-$C_8H_{17}$(t) | 61a | 61c | 61f | 61g |
| 62 | 4-$OCH_3$ | 62a | 62c | 62f | 62g |
| 63 | 3-$NO_2$ | 63a | 63c | 63f | 63g |

-continued
| | | | | | |
|---|---|---|---|---|---|
| 64 | 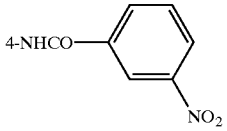 | 64a | 64c | 64f | 64g |
| 65 | 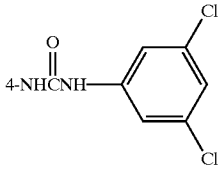 | 65a | 65c | 65f | 65g |
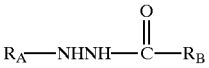
| $R_A$ = | $R_B$ = | | | |
|---|---|---|---|---|
| | —H | 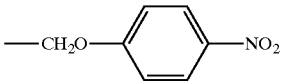 | 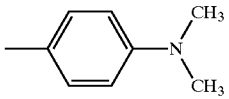 | 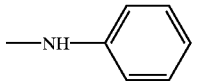 |
| 66 | 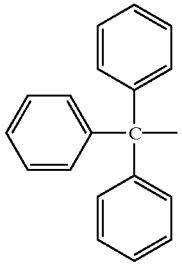 | 66a | 66u | 66v | 66t |

-continued
| | | | | | |
|---|---|---|---|---|---|
| 67 | 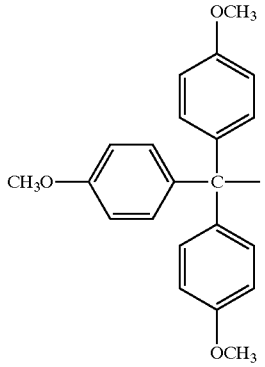 | 67a | 67u | 67v | 67t |
| 68 | 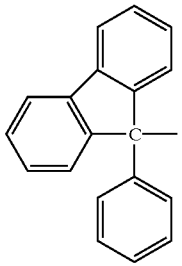 | 68a | 68u | 68v | 68t |
| 69 | 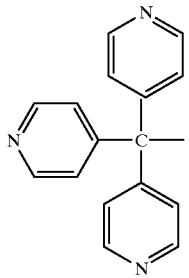 | 69a | 69u | 69v | 69t |

-continued
| | | | | | |
|---|---|---|---|---|---|
| 70 | 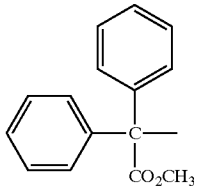 | 70a | 70u | 70v | 70t |
| 71 | 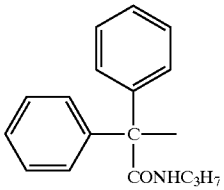 | 71a | 71u | 71v | 71t |
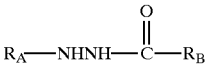
| $R_A$ = | $R_B$ = | | | |
|---|---|---|---|---|
| | 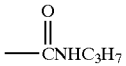 | 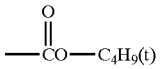 | $—OC_4H_9(t)$ | 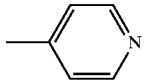 |
| 72 | 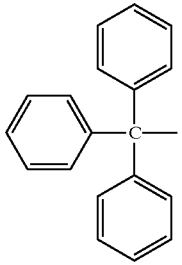 | 72s | 72x | 72y | 72w |

-continued
| | | | | | |
|---|---|---|---|---|---|
| 73 | 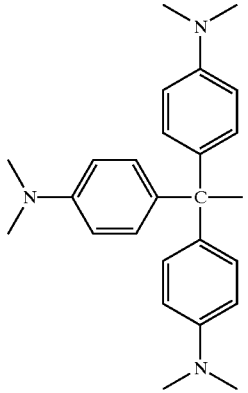 | 73s | 73x | 73y | 73w |
| 74 | 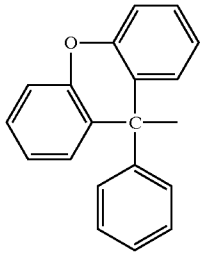 | 74s | 74x | 74y | 74w |
| 75 | 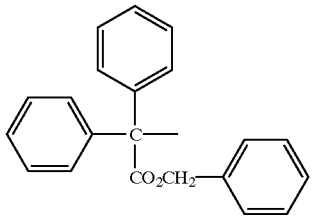 | 75s | 75x | 75y | 75w |

-continued
76
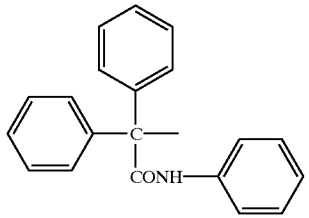
76s 76x 76y 76w
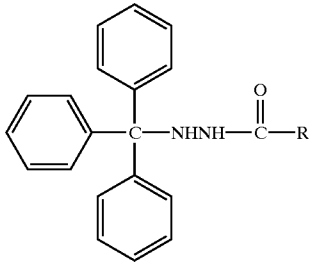
R =
77
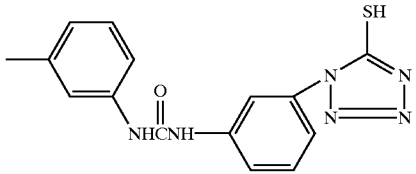
78
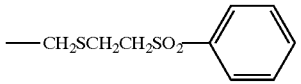
79 —$CH_2OCH_2CH_2SCH_2CH_2OCH_3$
80 —$CF_2CF_2COOH$
81
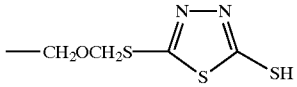

-continued
82
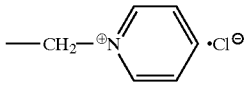
83
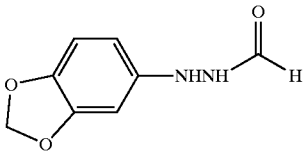
84
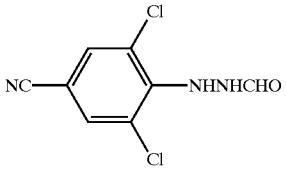
85
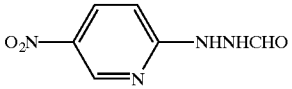
86
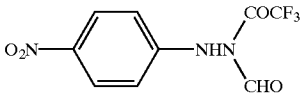
87
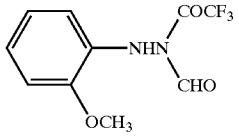
88
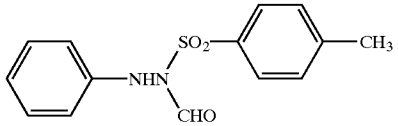

-continued
89
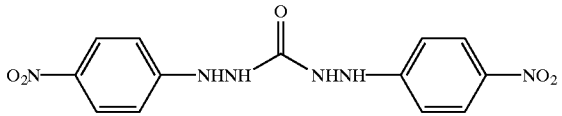
90
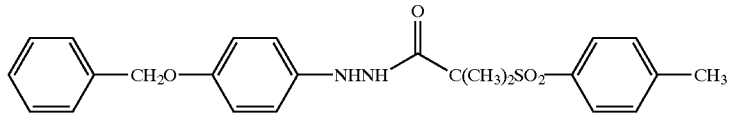
91
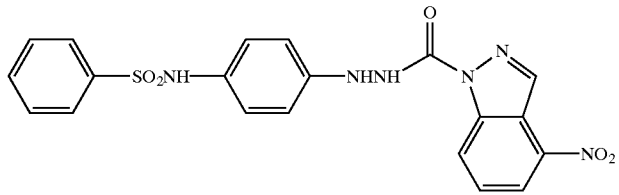
92
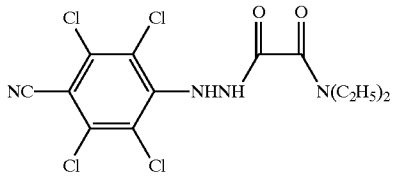
93
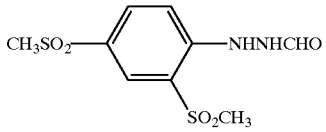
94
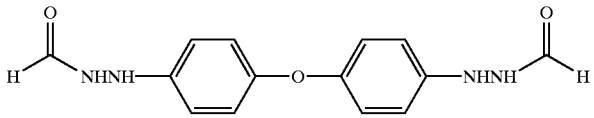
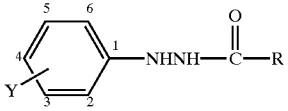

-continued
| | Y = | R = 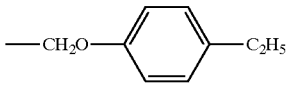 | 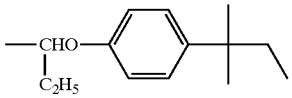 | 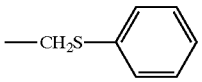 | $—CH_2—Cl$ |
|---|---|---|---|---|---|
| 95 | 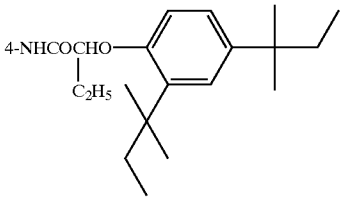 | 95-1 | 95-2 | 95-3 | 95-4 |
| 96 | 4-COOH | 96-1 | 96-2 | 96-3 | 96-4 |
| 97 | 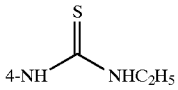 | 97-1 | 97-2 | 97-3 | 97-4 |
| 98 | 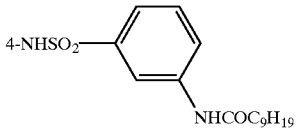 | 98-1 | 98-2 | 98-3 | 98-4 |
| 99 | 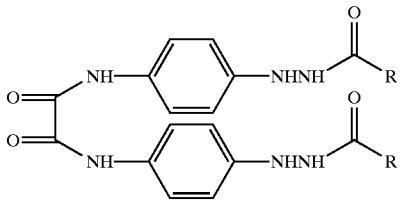 | 99-1 | 99-2 | 99-3 | 99-4 |
| 100 | 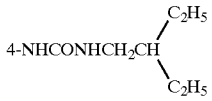 | 100-1 | 100-2 | 100-3 | 100-4 |

-continued
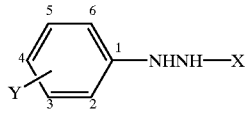
| | Y = | X = | | | |
|---|---|---|---|---|---|
| | | 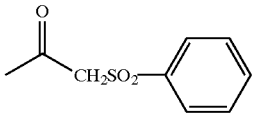 | 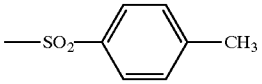 | 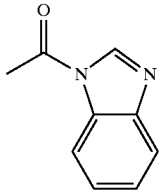 | 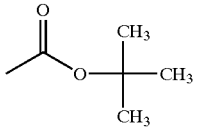 |
| 101 | 4-$NO_2$ | 101-5 | 101-6 | 101-7 | 101y |
| 102 | 2,4-$OCH_3$ | 102-5 | 102-6 | 102-7 | 102y |
| 103 | 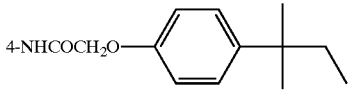 | 103-5 | 103-6 | 103-7 | 103y |
| | Y = | X = | | | |
|---|---|---|---|---|---|
| | | 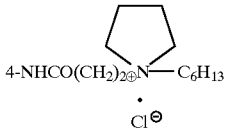 | 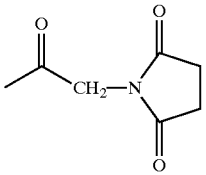 | 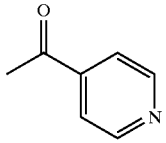 | 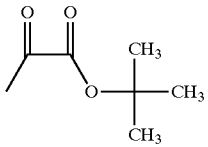 |
| 104 | 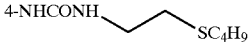 | 104-8 | 104-9 | 104w' | 104x |
| 105 | 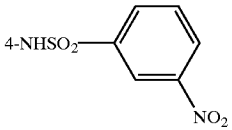 | 105-8 | 105-9 | 105w' | 105x |
Y—NHNH—X
| X = |
|---|

-continued
| | Y = | 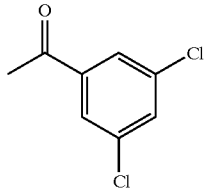 | 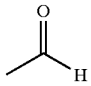 | 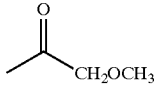 | 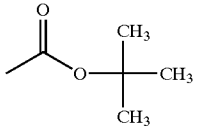 |
|---|---|---|---|---|---|
| 106 | 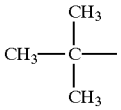 | 106-10 | 106a | 106m | 106y |
| 107 | 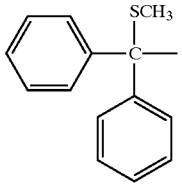 | 107-10 | 107a | 107m | 107y |
| 108 | 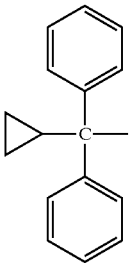 | 108-10 | 108a | 108m | 108y |
| 109 | 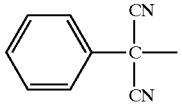 | 109-10 | 109a | 109m | 109y |
| 110 | 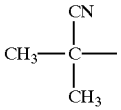 | 110-10 | 110a | 110m | 110y |

-continued
| | | | | | |
|---|---|---|---|---|---|
| 111 | 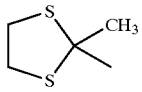 | 111-10 | 111a | 111m | 111y |
Y—NHNH—X
| | X = | | | |
|---|---|---|---|---|
| Y = | 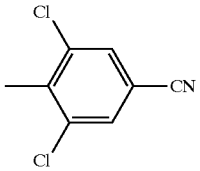 | 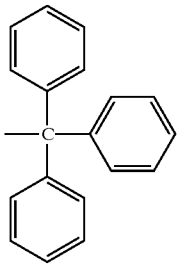 | 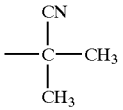 | 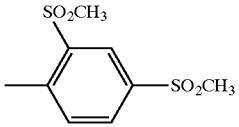 |
| 112 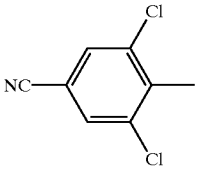 | 112-11 | 112-12 | 112-13 | 112-14 |
| 113 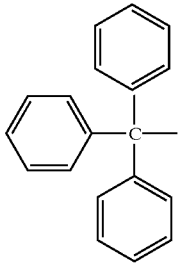 | 113-11 | 113-12 | 113-13 | 113-14 |
| 114 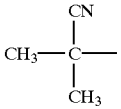 | 114-11 | 114-12 | 114-13 | 114-14 |

-continued
| | | | | | |
|---|---|---|---|---|---|
| 115 | 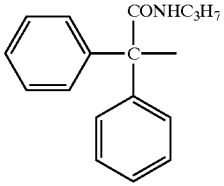 | 115-11 | 115-12 | 115-13 | 115-14 |
| 116 | 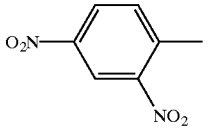 | 116-11 | 116-12 | 116-13 | 116-14 |
| 117 | 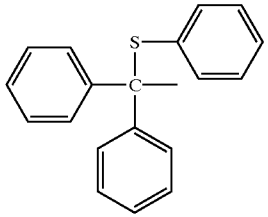 | 117-11 | 117-12 | 117-13 | 117-14 |
| 118 | 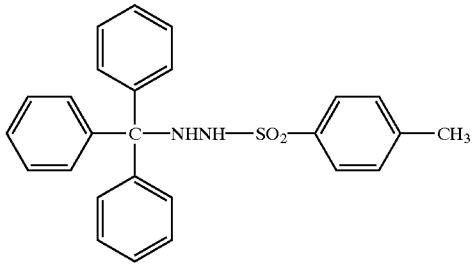 | | | | |

-continued
119
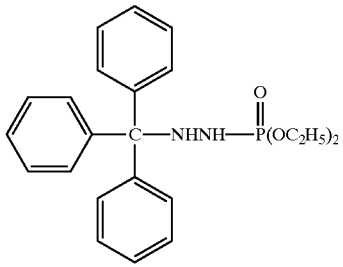
120
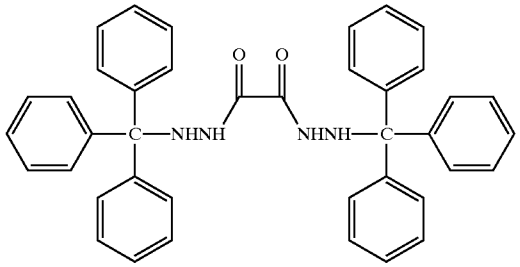
121
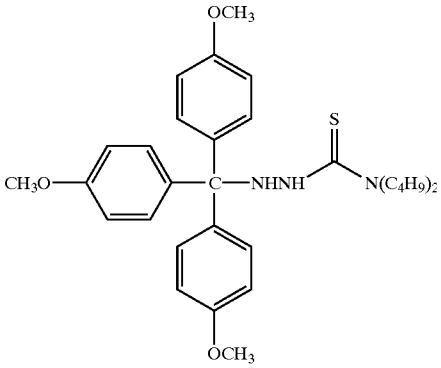

-continued
122
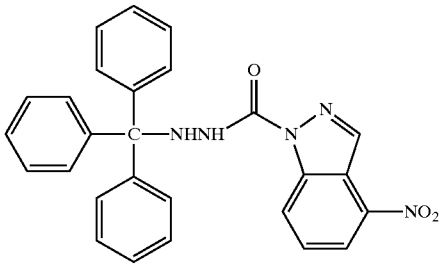
123
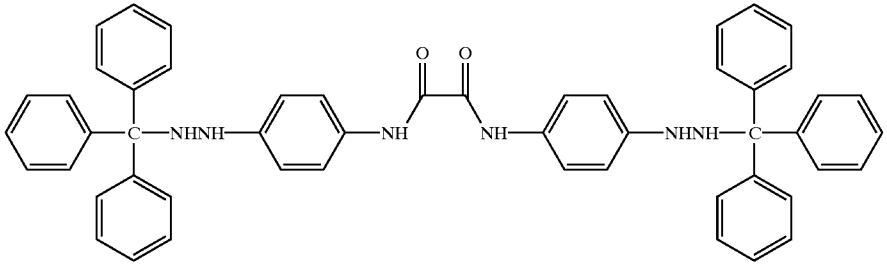

The hydrazine derivatives represented by the formula (H) can be used alone or in any combination of two or more kinds of them.

In addition to the above-described hydrazine derivatives, the hydrazine derivatives described below may also be preferably used in the present invention (depending on the case, the hydrazine derivatives may be used in combination). Furthermore, the hydrazine derivative for use in the present invention can be synthesized by various methods described in the following patent publications.

Examples of the hydrazine derivative other than the hydrazine derivative described in the foregoing include the compounds represented by (Chem. 1) of JP-B-6-77138, specifically, compounds described at pages 3 and 4 of the publication; the compounds represented by the formula (I) of JP-B-6-93082, specifically, Compounds 1-38 described at pages 8 to 18 of the publication; the compounds represented by the formulae (4), (5) and (6) of JP-A-6-230497, specifically, Compounds 4-1 to 4-10 described at pages 25 and 26, Compounds 5-1 to 5-42 described at pages 28 to 36 and Compounds 6-1 to 6-7 described at pages 39 and 40 of the publication; the compounds represented by the formulae (1) and (2) of JP-A-6-289520, specifically, Compounds 1-1) to 1-17) and 2-1) described at pages 5 to 7 of the publication; the compounds represented by (Chem. 2) and (Chem. 3) of JP-A-6-313936, specifically, compounds described at pages 6 to 19 of the publication; the compound represented by (Chem. 1) of JP-A-6-313951, specifically, the compounds described at pages 3 to 5 of the publication; the compound represented by the formula (I) of JP-A-7-5610, specifically, Compounds I-1 to I-38 described at pages 5 to 10 of the publication; the compounds represented by the formula (II) of JP-A-7-77783, specifically, Compounds II-1 to II-102 described at pages 10 to 27 of the publication; the compounds represented by the formulae (H) and (Ha) of JP-A-7-104426, specifically, Compounds H-1 to H-44 described at pages 8 to 15 of the publication; the compounds characterized by having in the vicinity of the hydrazine group an anionic group or a nonionic group capable of forming an internal hydrogen bond with a hydrogen atom of hydrazine, described in JP-A-9-22082, particularly, the compounds represented by the formulae (A), (B), (C), (D), (E) and (F), specifically, Compounds N-1 to N-30 described in the publication; the compound represented by the formula (1) described in JP-A-9-22082, specifically, Compounds D-1 to D-55 described in the publication; various hydrazine derivatives described at pages 25 to 34 of *Kochi Gijutsu (Known Techniques)*, pages 1 to 207, Aztech (issued on Mar. 22, 1991); and Compounds D-2 and D-39 described in JP-A-62-86354 (pages 6 and 7).

The hydrazine derivatives for use in the present invention may be used after dissolving it in an appropriate organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve.

Also, the hydrazine derivatives for use in the present invention each may be dissolved by an already well-known emulsification dispersion method using an oil such as dibutyl phthalate, tricresyl phosphate, glyceryl triacetate or diethyl phthalate, or an auxiliary solvent such as ethyl acetate or cyclohexanone, and mechanically formed into an emulsified dispersion before use. Furthermore, they may be used after dispersing the powder of the hydrazine derivative in water by a method known as a solid dispersion method, using a ball mill, colloid mill or ultrasonic wave.

The hydrazine derivatives for use in the present invention may be added to any layers on the image-forming layer side on the support, i.e., the image-forming layer or other layers on that layer side; however, they are preferably added to an image-forming layer or a layer adjacent thereto.

The addition amount of the hydrazine derivatives for use in the present invention is preferably from $1\times10^{-6}$ to $1\times10^{-2}$ mol, more preferably from $1\times10^{-5}$ to $5\times10^{-3}$ mol, most preferably from $2\times10^{-5}$ to $5\times10^{-3}$ mol, per mol of silver.

In the present invention, a contrast accelerator may be used in combination with the above-described ultrahigh contrast agent so as to form an ultrahigh contrast image. Examples thereof include amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1 to CN-13, hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14.

The synthesis methods, addition methods and addition amounts of the aforementioned ultrahigh contrast agents and the contrast accelerators may be according to those described in the patent publications cited above.

The heat-developable image-recording material of the present invention may contain a sensitizing dye. The sensitizing dye may be any one of those that can spectrally sensitize the halogenated silver halide particles at a desired wavelength region when they are adsorbed on the halogenated silver halide particles. As such sensitizing dyes, usable are, for example, cyanine dyes, merocyanine dyes, complex cyanine dyes, complex merocyanine dyes, holopolar cyanine dyes, styryl dyes, hemicyanine dyes, oxonole dyes and hemioxonole dyes. Sensitizing dyes which are usable in the present invention are described, for example, in Research Disclosure, Item 17643, IV-A (December, 1978, page 23), Item 1831X (August, 1978, page 437) and also in the references as referred to in them. In particular, sensitizing dyes having a color sensitivity suitable for spectral characteristics of light sources of various laser imagers, scanners, image setters, process cameras and the like can advantageously be selected.

Exemplary dyes for spectral sensitization to so-called red light from light sources such as He-Ne laser, red semiconductor laser, and LED include Compounds I-1 to I-38 disclosed in JP-A-54-18726, Compounds I-1 to I-35 disclosed in JP-A-6-75322, Compounds I-1 to I-34 disclosed in JP-A-7-287338, Dyes 1 to 20 disclosed in JP-B-55-39818, Compounds I-1 to I-37 disclosed in JP-A-62-284343, and Compounds I-1 to I-34 disclosed in JP-A-7-287338.

Spectral sensitization as to the wavelength region of from 750 to 1,400 nm from semiconductor laser light sources can advantageously be obtained with various known dyes such as a cyanine dye, a merocyanine dye, a styryl dye, a hemicyanine dye, an oxonol dye, a hemioxonol dye and a xanthene dye. Useful cyanine dyes are cyanine dyes having a basic nucleus such as thiazoline nucleus, oxazoline nucleus, pyrroline nucleus, pyridine nucleus, oxazole nucleus, thiazole nucleus, selenazole nucleus or imidazole nucleus. Useful merocyanine dyes are merocyanine dyes having the above-described basic nucleus or an acidic nucleus such as thiohydantoin nucleus, rhodanine nucleus, oxazolidinedione nucleus, thiazolinedione nucleus, barbituric acid nucleus, thiazolinone nucleus, malononitrile nucleus or pyrazolone nucleus. Of these cyanine and merocyanine dyes, those having an imino group or a carboxyl group are particularly effective. The dye may be appropriately selected from known dyes described, for example, in U.S. Pat. Nos. 3,761,279, 3,719,495 and 3,877,943, British Patent Nos. 1,466,201, 1,469,117 and 1,422,057, JP-B-3-10391, JP-B-6-52387, JP-A-5-341432, JP-A-6-194781 and JP-A-6-301141.

The dyes particularly preferably used for the present invention are cyanine dyes having a thioether bond (e.g., cyanine dyes described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-W-A-7-500926 (the code "JP-W-A" as used herein means an "international application published in Japanese for Japanese national phase"), and U.S. Pat. No. 5,541,054), dyes having a carboxylic acid group (e.g., dyes disclosed in JP-A-3-163440, JP-A-6-301141, and U.S. Pat. No. 5,441,899), merocyanine dyes, polynuclear merocyanine dyes and polynuclear cyanine dyes (dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-A-7-146537, JP-A-W-55-50111, British Patent No. 1,467,638, and U.S. Pat. No. 5,281,515) and the like.

Dyes forming J-band have been disclosed in U.S. Pat. Nos. 5,510,236, 3,871,887 (Example 5), JP-A-2-96131, JP-A-59-48753 and the like, and they can preferably be used for the present invention.

These sensitizing dyes may be used either individually or in combination of two or more thereof. The combination of sensitizing dyes is often used for the purpose of supersensitization. In combination with the sensitizing dye, a dye which itself has no spectral sensitization effect or a material which absorbs substantially no visible light, but which exhibits supersensitization may be incorporated into the emulsion. Useful sensitizing dyes, combinations of dyes which exhibit supersensitization, and materials which show supersensitization are described in *Research Disclosure*, Vol. 176, 17643, page 23, Item IV-J (December, 1978), JP-B-49-25500, JP-B-43-4933, JP-A-59-19032, JP-A-59-192242 and the like.

The sensitizing dyes may be used in combination of two or more of them for the present invention. The sensitizing dye may be added to the silver halide emulsion by dispersing it directly in the emulsion or may be added to the emulsion after dissolving it in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide, and the solvent may be a sole solvent or a mixed solvent.

Furthermore, the sensitizing dye may be added using a method disclosed in U.S. Pat. No. 3,469,987 where a dye is dissolved in a volatile organic solvent, the solution is dispersed in water or hydrophilic colloid, and the dispersion is added to an emulsion, a method disclosed in JP-B-44-23389, JP-B-44-27555 and JP-B-57-22091 where a dye is dissolved in an acid and the solution is added to an emulsion or the solution is formed into an aqueous solution while allowing the presence together of an acid or base and then added to an emulsion, a method disclosed in U.S. Pat. Nos. 3,822,135 and 4,006,025 where an aqueous solution or colloid dispersion of a dye is formed in the presence of a surface active agent and the solution or dispersion is added to an emulsion, a method disclosed in JP-A-53-102733 and JP-A-58-105141 where a dye is dissolved directly in hydrophilic colloid and the dispersion is added to an emulsion, or a method disclosed in JP-A-51-74624 where a dye is dissolved using a compound capable of red shifting and the solution is added to an emulsion. An ultrasonic wave may also be used in dissolving the dye.

The sensitizing dye for use in the present invention may be added to a silver halide emulsion for use in the present invention in any step heretofore known to be useful in the preparation of an emulsion. The sensitizing dye may be added in any time period or step before the coating of the emulsion, for example, in the grain formation process of silver halide and/or before desalting or during the desalting process and/or the time period from desalting until initiation of chemical ripening, as disclosed in U.S. Pat. Nos. 2,735,766, 3,628,960, 4,183,756 and 4,225,666, JP-A-58-184142 and JP-A-60-196749, or immediately before or during the chemical ripening process or in the time period after chemical ripening until coating, as disclosed in JP-A-58-113920. Furthermore, as disclosed in U.S. Pat. No. 4,225,666 and JP-A-58-7629, the same compound by itself may be added in parts or a compound in combination with another compound having a different structure may be added in parts, for example, one part is added during grain formation and another part is added during or after chemical ripening, or one part is added before or during chemical ripening and another part is added after completion of the chemical ripening, and when the compound is added in parts, the combination of the compound added in parts with another compound may also be changed.

The amount of the sensitizing dye used in the present invention may be selected according to the performance such as sensitivity or fog; however, it is preferably from $10^{-6}$ to 1 mol, more preferably from $10^{-4}$ to $10^{-1}$ mol, per mol of silver halide in the light-sensitive layer that is the image-forming layer.

The silver halide emulsion and/or organic silver salt for use in the present invention can be further prevented from the production of additional fog or stabilized against the reduction in sensitivity during the stock storage, by an antifoggant, a stabilizer or a stabilizer precursor. Examples of antifoggants, stabilizers and stabilizer precursors which can be appropriately used individually or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechol described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, and phosphorus compounds described in U.S. Pat. No. 4,411,985.

The antifoggant which is preferably used in the present invention is an organic halide, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737.

The antifoggant for use in the present invention may be added in any form of a solution, powder, solid microparticle dispersion and the like. The solid microparticle dispersion is performed using a known pulverization means (e.g., ball mill, vibrating ball mill, sand mill, colloid mill, jet mill, roller mill). At the time of solid microparticle dispersion, a dispersion aid may also be used.

Although not necessary for practicing the present invention, it is advantageous in some cases to add a mercury(II) salt as an antifoggant to the image-forming layer. Preferred mercury(II) salts for this purpose are mercury acetate and mercury bromide. The addition amount of mercury for use in the present invention is preferably from $1\times10^{-9}$ to $1\times10^{-3}$ mol, more preferably from $1\times10^{-8}$ to $1\times10^{-4}$ mol, per mol of silver coated.

The heat-developable image-recording material of the present invention may contain a benzoic acid compound for the purpose of achieving high sensitivity or preventing fog. The benzoic acid compound for use in the present invention may be any benzoic acid derivative, but preferred examples of the structure include the compounds described in U.S. Pat. Nos. 4,784,939 and 4,152,160 and JP-A-9-329863, JP-A-9-329864 and JP-A-9-281637. The benzoic acid compound for use in the present invention may be added to any site of the light-sensitive material, but the layer to which the benzoic acid is added is preferably a layer on the surface having the image-forming layer such as a light-sensitive layer, more preferably an organic silver salt-containing layer that is the image-forming layer. The benzoic acid compound for use in the present invention may be added at any step during the preparation of the coating solution. In the case of adding the benzoic acid compound to an organic silver salt-containing layer, it may be added at any step from the preparation of the organic silver salt until the preparation of the coating solution, but is preferably added in the period after the preparation of the organic silver salt and immediately before the coating. The benzoic acid compound for use in the present invention may be added in any form of a powder, solution, microparticle dispersion and the like, or may be added as a solution containing a mixture of the benzoic acid compound with other additives such as a sensitizing dye, a reducing agent and a color toner. The benzoic acid compound for use in the present invention may be added in any amount; however, the addition amount thereof is preferably from $1\times10^{-6}$ to 2 mol, more preferably from $1\times10^{-3}$ to 0.5 mol, per mol of silver.

The heat-developable image-recording material of the present invention may contain a mercapto compound, a disulfide compound or a thione compound so as to control the development by inhibiting or accelerating the development, improve the spectral sensitization efficiency or improve the storage stability before or after the development.

In the case of using a mercapto compound in the present invention, any structure may be used but those represented by Ar—SM or Ar—S—S-Ar are preferred, wherein M is a hydrogen atom or an alkali metal atom, and Ar is an aromatic ring or condensed aromatic ring containing one or more nitrogen, sulfur, oxygen, selenium or tellurium atoms, preferably a heteroaromatic ring such as benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group-consistingofhalogen (e.g., Br, Cl), hydroxy, amino, carboxy, alkyl (e.g., alkyl having one or more carbon atoms, preferably from 1 to 4 carbon atoms), and alkoxy (e.g., alkoxy having one or more carbon atoms, preferably from 1 to 4 carbon atoms). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 2-mercapto-4-phenyloxazole and the like. However, the present invention is by no means limited thereto.

The amount of the mercapto compound added is preferably from 0.0001 to 1.0 mol, more preferably from 0.001 to 0.3 mol, per mol of silver in an emulsion layer.

The image-forming layer such as a light-sensitive layer for use in the present invention may contain a plasticizer or lubricant, and examples thereof include polyhydric alcohols (for example, glycerins and diols described in U.S. Pat. No. 2,960,404), fatty acids or esters described in U.S. Pat. Nos. 2,588,765 and 3,121,060, and silicone resins described in British Patent No. 955,061.

The heat-developable photographic emulsion for use in the present invention is coated on a support to form one or more layers. In the case of a single-layer structure, the layer must contain an organic silver salt, a silver halide, a developer, a binder and additional desired materials such as a color toner, a coating aid and other auxiliary agents. In the case of a two-layer structure, the first emulsion layer (usually a layer adjacent to the substrate) must contain an organic silver salt and a silver halide and the second layer or both layer must contain some other components. However, a two-layer structure constituted by a single emulsion layer containing all components and a protective topcoat may also be used. A multi-color light-sensitive heat-developable photographic material may have a structure such that a combination of the above-described two layers is provided for respective colors, or, as described in U.S. Pat. No. 4,708,928, a structure such that a single layer contains all components. In the case of a multi-dye multi-color light-sensitive heat-developable photographic material, respective emulsion layers (light-sensitive layers) are generally kept away from each other by using a functional or non-functional barrier layer between respective light-sensitive layers as described in U.S. Pat. No. 4,460,681.

The light-sensitive layer that is the image-forming layer for use in the present invention may contain a dye or pigment of various types so as to improve the color tone or prevent the irradiation. Any dye or pigment may be used in the light-sensitive layer for use in the present invention, and examples thereof include pigments and dyes described in the color index. Specific examples thereof include organic pigments and inorganic pigments such as a pyrazoloazole dye, an anthraquinone dye, an azo dye, an azomethine dye, an oxonol dye, a carbocyanine dye, a styryl dye, a triphenylmethane dye, an indoaniline dye, an indophenol dye and phthalocyanine. Preferred examples of the dye for use in the present invention include anthraquinone dyes (e.g., Compounds 1 to 9 described in JP-A-5-341441, Compounds 3-6 to 3-18 and 3-23 to 3-38 described in JP-A-5-165147), azomethine dyes (e.g., Compounds 17 to 47 described in JP-A-5-341441), indoaniline dyes (e.g., Compounds 11 to 19 described in JP-A-5-289227, Compound 47 described in JP-A-5-341441, Compounds 2-10 and 2-11 described in JP-A-5-165147) and azo dyes (Compounds 10 to 16 described in JP-A-5-341441). The dye maybe added in any form of a solution, emulsified product or solid microparticle dispersion or may be added in the state mordanted with a polymer mordant. The amount of such a compound used may be determined according to the objective amount absorbed but, in general, the compound is preferably used in an amount of from $1\times10^{-6}$ to 1 g per square meter of the heat-developable image-recording material.

The heat-developable image-recording material of the present invention may comprise an antihalation layer on a side remoter from the light source than the light-sensitive layer. The antihalation layer preferably has a maximum absorption in a desired region of exposure light wavelength of from about 0.3 to 2, more preferably 0.5 to 2. Further, it preferably has an optical density in the visible region of from 0.001 to 0.5, more preferably from 0.001 to 0.3 after the treatment.

In the case when an antihalation dye is used in the present invention, the dye may be any compound so long as the compound has an objective absorption in the desired wavelength region, the absorption in the visible region can be sufficiently reduced after the processing, and the antihalation layer can have a preferred absorption spectrum form. While examples thereof include those described in the following patent publications, the present invention is by no means limited thereto: as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the processing, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-A-B-50-16648, JP-B-2-41734 and U.S. Pat. Nos. 4,088,497, 4,283,487, 4,548,896 and 5,187,049.

The heat-developable image-recording material of the present invention is preferably a so-called single-sided image-recording material comprising a support having on one side thereof at least one image-forming layer such as a light-sensitive layer containing a silver halide emulsion and on the other side thereof a back layer (backing layer).

In the present invention, the back layer preferably has a maximum absorption in a desired wavelength region of from about 0.3 to 2, more preferably 0.5 to 2. Further, it preferably has an optical density in the visible region of from 0.001 to 0.5, more preferably from 0.001 to 0.3. Examples of antihalation dye used for the back layer are similar to those mentioned for the aforementioned antihalation layer.

A backside resistive heating layer described in U.S. Pat. Nos. 4,460,681 and 4,374,921 may also be used in the light-sensitive heat-developable photographic image system.

In the present invention, the layers such as the image-forming layer, protective layer and back layer each may contain a hardening agent. Examples of the hardening agent include polyisocyanates described in U.S. Pat. No. 4,281,060 and JP-A-6-208193, epoxy compounds described in U.S. Pat. Nos. 4,791,042, and vinyl sulfone-based compounds described in JP-A-62-89048.

While the heat-developable image-recording material of the present invention may be developed by any method, development is usually performed by elevating the temperature of the image-recording material after the imagewise exposure. As mentioned above, the development temperature is from 80 to 140° C., more preferably from 100 to 140° C. The development time is preferably from 1 to 180 seconds, more preferably from 10 to 90 seconds.

The heat-developable image-recording material of the present invention may be light-exposed by any method but the light source for the exposure is preferably a laser ray. The laser ray for use in the present invention is preferably one from a gas laser, YAG laser, dye laser, semiconductor laser or the like. The semiconductor laser and a second harmonic generation device may be used in combination.

The heat-developable image-recording material of the present invention has a low haze at the exposure and is liable to incur generation of interference fringes. For preventing the generation of interference fringes, a technique of entering a laser ray obliquely with respect to the image-recording material disclosed in JP-A-5-113548 and a method of using a multimode laser disclosed in International Patent Publication WO95/31754 are known and these techniques are preferably used.

The heat-developable image-recording material of the present invention is preferably exposed such that the laser rays are overlapped and the scanning lines are not viewed as described in *SPIE*, Vol. 169, "Laser Printing", pages 116 to 128 (1979), JP-A-4-51043 and WO95/31754.

An exemplary structure of heat-developing apparatus used for the heat development of the heat-developable image-recording material of the present invention is shown in FIG. 1. FIG. 1 represents a side view of a heat-developing apparatus. The apparatus comprises a cylindrical heat drum 2, which is internally provided with a halogen lamp 1 as a heat source of the heating means, and a continuous belt 4 for conveyance, which is put on a plurality of feed rollers 3, is pressed against the circumferential surface of the heat drum 2. A heat-developable image-recording material 5 is transferred between the continuous belt 4 and the heat drum 2. During the transfer, the heat-developable image-recording material 5 is heated to a development temperature, and undergone the heat development. In this operation, the direction of the lamp is optimized, so that precise temperature control along the transverse direction can be obtained.

A straightening guide panel 7 is provided in the proximity of exit 6, where the heat-developable image-recording material 5 is fed out from the gap between the heat drum 2 and the continuous belt 4, and the guide panel 7 straightens the heat-developable image-recording material 5 released from the curved circumferential surface of the heat drum 2 into a flat form. The atmospheric temperature around the straightening guide panel 7 is controlled so that the temperature of the heat-developable image-recording material 5 should not be lowered to a temperature below a certain level.

A pair of feed rollers 8 for transferring the heat-developable image-recording material 5 is provided downstream the exit 6, and flat guide panels 9 are provided next to, and downstream from the feed rollers 8, and guide the heat-developable image-recording material 5 maintained flat. Further, another pair of feed rollers 10 is provided downstream from, and next to the flat guide panels 9. The flat guide panels 9 have such a length that the heat-developable image-recording material 5 should be cooled during the transfer between them. That is, the heat-developable image-recording material 5 is cooled to a temperature of 30° C. or lower during the transfer between them. As a cooling means for the flat guide panels 9, cooling fans 11 are provided.

While the heat-development apparatus is explained with reference to the example shown in the drawing, it is not limited to this, and may have various structures.

The present invention will be specifically explained with reference to the following examples. The materials, ratios, procedures and the like shown in the following examples can be optionally changed so long as such change does not depart from the spirit of the present invention. Therefore, the scope of the present invention is not limited to the following examples.

EXAMPLE 1

(1) Preparation of Support (Base)

PET having IV (intrinsic viscosity) of 0.66 (measured in phenol/tetrachloroethane=6/4 (weight ratio) at 25° C.) was obtained by using terephthalic acid and ethylene glycol in a conventional manner. This was pelletized, dried at 130° C. for 4 hours, melted at 300° C., extruded from a T-die, and quenched to form an unstretched film having a thickness of 120 μm after thermal fixation.

This film was stretched along the longitudinal direction by 3.3 times using rollers of different peripheral speeds, and then stretched along the transverse direction by 4.5 times using a tenter. The temperatures used for these operations were 110° C. and 130° C., respectively. Then, the film was subjected to thermal fixation at 240° C. for 20 seconds, and relaxed by 4% along the transverse direction at the same temperature. Thereafter, the chuck of the tenter was released, the both edges of the film were knurled, and the film was rolled at 4.8 kg/cm$^2$. Thus, a roll of a film having a width of 2.4 m, length of 3500 m, and thickness of 120 μm was obtained.

(2) Undercoat Layer

<Undercoat Layer (a-1)>

Polymer latex V-5 (core shell type latex comprising 90% by weight of core and 10% by weight of shell, average molecular weight; 38000, core: vinylidene chloride/methyl acrylate/methyl methacrylate/acrylonitrile/acrylic acid=93/3/3/0.9/0.1 (% by weight), shell; vinylidene chloride/methyl acrylate/methyl methacrylate/acrylonitrile/acrylic acid=88/3/3/3/3 (% by weight)) 3.0 g/m$^2$ as solid content 2,4-Dichloro-6-hydroxy-s-triazine 23 mg/m$^2$ Matting agent (polystyrene, average diameter; 2.4 μm) 1.5 mg/m$^2$ <Undercoat Layer (a-2)>

Polymer latex (styrene/butadiene/hydroxyethyl methacrylate/divinylbenzene=67/30/2.5/0.5 (% by weight)) 160 mg/m$^2$ as solid content 2,4-Dichloro-6-hydroxy-s-triazine 4 mg/m$^2$ Matting agent (polystyrene, average diameter; 2.4 μm) 3 mg/m$^2$ <Undercoat Layer (b)>

Alkali treated gelatin 50 mg/m$^2$ ($Ca^{++}$ content; 30 ppm, jelly strength; 230 g)

(3) Electroconductive layer (surface resistivity at 25° C. and 25% RH; $10^9$ Ω)

Julimer ET-410 38 mg/m$^2$ (Nihon Junyaku Co., Ltd., Tg=52° C.)

$SnO_2$/Sb 120 mg/m$^2$ (weight ratio; 9/1, average particle size; 0.25 μm)

Matting agent 7 mg/m$^2$ (Polymethyl methacrylate, average particle size; 5 μm)

Denacol EX-614B (Nagase Kasei Co., Ltd.) 13 mg/m$^2$

(4) Protective Layer (Back Face)

CHEMIPEARL S-120 500 mg/m$^2$ (Mitsui Petrochemical Industries, Ltd., Tg=77° C.)

Snowtex-C (Nissan Chemical Industries, Ltd.) 40 mg/m$^2$

Denacol EX-614B (Nagase Kasei Co., Ltd.) 30 mg/m$^2$

(5) Preparation of Support I

Undercoat layer (a-1) and Undercoat layer (b) were successively applied on both sides of the support (base), and each dried at 180° C. for 4 minutes. Then, an electroconductive layer and a protective layer are successively applied to one side after applying Undercoat layer (a-1) and Undercoat layer (b), and each dried at 180° C. for 4 minutes to prepare PET Support I having back layers and undercoat layers. The dry thickness of Undercoat layer (a-1) was 2.0 μm (for one side).

(6) Preparation of Support II

In a similar manner, Undercoat layer (a-2) and Undercoat layer (b) were applied successively on both sides of the support (base), and each dried at 180° C. for 4 minutes. Then, an electroconductive layer and a protective layer are successively applied to one side, and each dried at 180° C. for 4 minutes to prepare PET Support II having back layers and undercoat layers. The dry thickness of Undercoat layer (a-2) was 2.0 μm (for one side).

(7) Heat Treatment During Conveyance (7-1) Heat Treatment

PET supports I and II with back layers and undercoat layers were conveyed in a heat treatment zone having a total length of 200 m and set at each temperature and tension mentioned in Table 23 at a conveying speed of 20 m/minute.

(7-2) Post-heat Treatment

Following the aforementioned heat treatment, each support was subjected to post-heat treatment at each temperature and tension mentioned in Table 23, and rolled up. The rolling up tension for this operation was 10 kg/cm$^2$.

In the manner described above, the supports mentioned in Table 23 were obtained. In Table 23, the rate of dimensional change and presence or absence of depression generation after these supports were subjected to heating at 120° C. for 30 seconds are also shown together. The rate of dimensional change was determined in the same manner as in the measurement of the rate of dimensional change upon heat treatment described hereinafter, and the depression was evaluated by visual observation.

TABLE 23

| No. of support with back layer/undercoat layer | Heat treatment Tension (kg/cm²) | Heat treatment Temperature (° C.) | Post-heat treatment Time (second) | Post-heat treatment Temperature (° C.) | Rate of dimensional change after heat treatment at 120° C. for 30 seconds (%) MD | Rate of dimensional change after heat treatment at 120° C. for 30 seconds (%) TD | Presence or absence of film depression after heat development |
|---|---|---|---|---|---|---|---|
| I-1 | No heat treatment | | No heat treatment | | −0.150 | 0.810 | Present |
| I-2 | 3 | 130 | 15 | 40 | −0.004 | 0.013 | Absent |
| I-3 | 5 | 130 | 15 | 40 | −0.008 | 0.018 | Absent |
| I-4 | 7 | 130 | 15 | 40 | −0.009 | 0.024 | Absent |
| I-5 | 10 | 130 | 15 | 40 | −0.026 | 0.036 | Absent |
| I-6 | 3 | 160 | 15 | 40 | −0.004 | 0.013 | Absent |
| I-7 | 3 | 185 | 15 | 40 | −0.003 | 0.009 | Absent |
| I-8 | 3 | 200 | 15 | 40 | −0.028 | 0.024 | Absent |
| II-1 | No heat treatment | | No heat treatment | | −0.150 | 0.800 | Present |
| II-2 | 3 | 130 | 15 | 40 | −0.005 | 0.015 | Absent |
| II-3 | 5 | 130 | 15 | 40 | −0.008 | 0.019 | Absent |
| II-4 | 7 | 130 | 15 | 40 | −0.010 | 0.025 | Absent |
| II-5 | 10 | 130 | 15 | 40 | −0.025 | 0.035 | Absent |
| II-6 | 3 | 160 | 15 | 40 | −0.005 | 0.014 | Absent |
| II-7 | 3 | 185 | 15 | 40 | −0.003 | 0.010 | Absent |
| II-8 | 3 | 200 | 15 | 40 | −0.030 | 0.025 | Absent |

MD: Machine direction,
TD: Transverse direction

Then, the following image-forming layer and the protective layer mentioned below were successively applied on the undercoat layer, and each dried at 65° C. for 3 minutes to afford each of the samples of the heat-developable image-recording material shown in Table 24.

(8) Image-forming layer (Preparation of Silver Halide Grains)

Into 700 ml of water, 11 g of phthalized gelatin, 30 mg of potassium bromide and 10 mg of sodium thiosulfonate were dissolved, and after adjusting the pH to 5.0 at a temperature of 35° C., 159 ml of an aqueous solution containing 18.6 g of silver nitrate and an aqueous solution containing 1 mol/l of potassium bromide were added by the control double jet method over 6.5 minutes while keeping the pAg at 7.7. Subsequently, 476 ml of an aqueous solution containing 55.4 g of silver nitrate and an aqueous halogen salt solution containing 1 mol/l of potassiumbromide were added by the control double jet method over 30 minutes seconds while keeping the pAg at 7.7, and then 1 g of 4-hydroxy-6-methyl-1,3,3a,7-tetrazaindene was added. Thereafter, the pH was lowered to cause coagulation precipitation to effect desalting, 0.1 g of phenoxyethanol was added, and the pH and the pAg were adjusted to 5.9 and 8.2, respectively, to complete the preparation of silver bromide grains (cubic grains having an average grain size of 0.12 μm, a coefficient of variation of the projected area of 8%, and a (100) face ratio of 88%).

The silver halide grains obtained above was warmed to 60° C., added with sodium thiosulfonate in an amount of $8.5\times10^{-4}$ mol per mol of silver, ripened for 120 minutes, quenched to 40° C., added with $1\times10^{-5}$ mol of Dye S-1, $5\times10^{-5}$ mol of 2-mercapto-5-methylbenzimidazole and $5\times10^{-5}$ mol of N-methyl-N'-{3-mercaptotetrazolyl)phenyl} urea, and quenched to 30° C. to obtain silver halide emulsion.

S-1

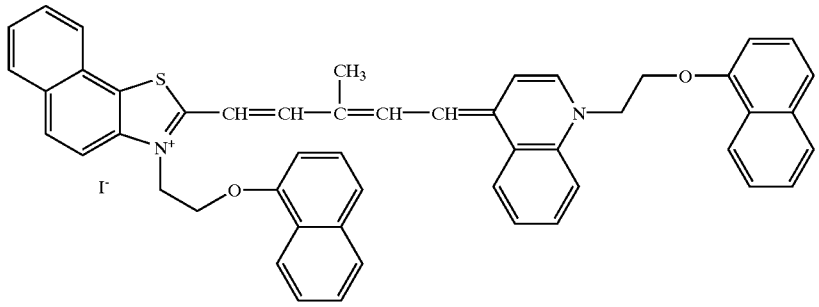

(Preparation of Organic Acid Silver Salt Dispersion)

103 ml of 1N aqueous NaOH solution was added to 4.4 g of stearic acid and 39.4 g of behenic acid in 770 ml of distilled water with stirring at 90° C., allowed to react for 240 minutes, and cooled to 75° C. Then, 112.5 ml of an aqueous solution containing 19.2 g of silver nitrate was added over 45 seconds to the reaction mixture, which was then left as it was for 20 minutes to be cooled to 30° C. Thereafter, the solid content was separated by suction filtration, and the solid content was washed with water until the conductivity of the filtered water became 30 μS/cm. The solid content obtained as described above was added with 100 g of 10 wt % aqueous solution of hydroxypropylmethyl cellulose, and water of such an amount that the total weight should be 270 g, and roughly dispersed by an automatic mortar. This roughly dispersed organic acid silver salt was dispersed by a nanomizer (Nanomizer Co., Ltd.) at a pressure of 1000 kg/cm$^3$ upon impact to obtain an organic acid silver salt dispersion. The organic acid silver salt grains contained in the organic acid silver salt dispersion obtained as described above were acicular grains having an average short axis length of 0.04 $\mu$m, an average long axis length of 0.8 $\mu$m and a variation coefficient of 30%.

(Preparation of Reducing Agent Dispersion)

To 100 g of 1,1-bis(2-hydroxy-3,5-dimethylphenyl)-3,5,5-trimethylhexane and 50 g of hydrozypropyl cellulose, 850 g of water was added and sufficiently stirred to form a slurry. The slurry was introduced into a vessel together with 840 g of zirconia beads having an average particle size of 0.5 mm, and dispersed in a dispersing machine (1/4G Sand Grinder Mill, Imex Co., Ltd.) for 5 hours to prepare a reducing agent dispersion.

(Preparation of Organic Polyhalogenide Dispersion)

To 50 g of tribromomethylphenylsulfone and 10 g of hydroxypropylmethyl cellulose, 940 g of water was added and sufficiently stirred to form a slurry. The slurry was introduced into a vessel together with 840 g of zirconia beads having an average particle size of 0.5 nm, and dispersed in a dispersing machine (1/4G Sand Grinder Mill, Imex Co., Ltd.) for 5 hours to prepare a organic polyhalogenide dispersion.

(Preparation of Coating Solution for Image-Forming Layer)

100 g of the organic acid silver salt dispersion obtained above, 20 g of the reducing agent dispersion obtained above, 15 g of the organic polyhalogenide dispersion obtained above, 40 g of 49 wt % LACSTAR3307B (Dainippon Ink & Chemicals, Inc., SBR latex, Tg=13° C.), 20 g of 10 wt % aqueous solution of MP-203 (Kuraray Co., Ltd., polyvinyl alcohol), 20 g of silver halogenide emulsion, 8 ml of 1 wt % methanol solution of hydrazine derivative (the exemplary compound 37a), and 100 g of water were sufficiently mixed to form a coating solution for image-forming layer.

This coating solution was applied in such an amount that a coated silver amount of 1.5 g/m$^2$ and coated polymer latex solid content amount of 5.7 g/m$^2$ should be obtained.

(9) Protective layer A (Preparation of Coating Solution for Protective Layer)

262 g of $H_2O$ was added to 500 g of a 40 wt % polymer latex (copolymer of methyl methacrylate/styrene/2-ethylhexyl acrylate/2-hydroxyethyl methacrylate/methacrylic acid=59/9/26/5/1, Tg; 47° C.), added successively with 14 g of benzyl alcohol as a film forming aid, 2.5 g of Compound-2 mentioned below, 3.6 g of Cellosol (Chukyo Oil and Fat Co., Ltd.), 12 g of Compound-3 mentioned below, 1 g of Compound-4 mentioned below, 2 g of Compound-5 mentioned below, 7.5 g of Compound-6 mentioned below, and 3.4 g of polymethyl methacrylate microparticles having an average particle size of 3 $\mu$m as a matting agent, and further added with water in such an amount that the total weight should be 1000 g to prepare a coating solution having a viscosity of 5 cp (25° C.) and pH=3.4 (25° C.).

This coating solution was applied in such an amount that 2 g/m$^2$ of the solid content of the polymer latex should be coated.

Compound-2:

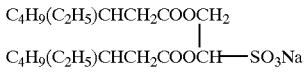

-continued

Compound-3:

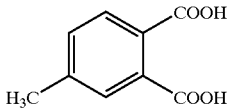

Compound-4:

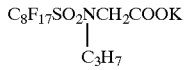

Compound-5:

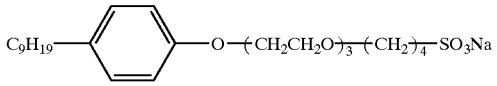

Compound-6:

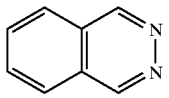

As for the obtained samples, generation of wrinkles after heat development, rate of dimensional change upon heat development, and rate of dimensional change over time after heat development were determined by the methods shown below. The results are shown in Table 24.

The values of Tg mentioned hereinabove were obtained by differential scanning calorimetry (DSC). The Beck smoothness of each sample was 1500 seconds as for the emulsion surface, and 350 seconds as for the back face.

1) Test Method for Evaluating Generation of Wrinkles After Heat Development

Using such a heat-developing apparatus as shown in FIG. 1, each sample (60 cm×75 cm in size) was heat-developed under conditions composed of a combination of development temperature of 110, 115 or 120° C., and the development time of 10, 20 or 30 seconds, and presence or absence of generation of wrinkles of the sample after the development was determined by visual observation. When the generation of wrinkles was not observed under any of the conditions, it was evaluated as "absent". When the generation of wrinkles was observed under any of the conditions, it was evaluated as "present".

The heat development was performed at a temperature precision of ±1° C. as for the transverse direction by optimizing the light distribution from the light in the drum type heat-developing apparatus shown in FIG. 1. Further, the atmospheric temperature was controlled so that the temperature 2) Measuring Method of Rate of Dimensional Change Upon Heat Development On a sample (5 cm×25 cm in size) light-exposed for the whole surface but before heat development, two holes each having a diameter of 8 mm were provided with a distance of about 200 mm, and the distance between the two holes was precisely measured by using a pin gauge of 1/1000 mm precision. The value measured at this time was represented by X (unit; mm). Then, the sample was heat-developed by using the heat-developing apparatus of FIG. 1 under the conditions of 120° C. for 30 seconds, and then the distance was measured by the pin gauge after 120 minutes. The value measured at this time was represented by Y (unit; mm). The evaluation was obtained based on the value calculated in accordance with the following equation. Rate of dimensional change (%)=[(Y−X)/200]×100

3) Measuring Method of Rate of Dimensional Change Over Time After Heat Development On a sample (5 cm×25 cm in size) light-exposed for the whole surface but before heat development, two holes each having a diameter of 8 mm were provided with a distance of about 200 mm, and the sample was heat-developed by using the heat-developing apparatus of FIG. 1 under the conditions of 120° C. for 30 seconds. The distance was measured by the pin gauge after 3 minutes. The value measured at this time was represented by $X_1$ (unit; mm). Then, the distance was measured after 240 minutes. The value measured at this time was represented by $Y_1$ (unit; mm).

This series of measurements was performed under the atmospheres of 75% RH at 25° C. and 20% RH at 25° C., respectively.

The evaluation was obtained based on the value calculated in accordance with the following equation.

$$\text{Rate of dimensional change (\%)}=[(Y_1-X_1)/200]\times 100$$

(a-1), i.e., 0.1 μm, 0.3 μm, 0.5 μm, 1 μm, 2 μm, 3 μm and 4 μm (for one side), were prepared in the same manner as in Example 1, applied with back layers as in Example 1, and subjected to the heat treatment during conveyance under the same conditions as the support No. I-2 mentioned in Table 23.

Then, the image-forming layer and the protective layer were applied to the side opposite to the back layer side in the same manner as in Example 1 to obtain Samples 21–27 shown in Table 25.

The obtained samples were evaluated as for the generation of wrinkles after heat development, the rate of dimensional change upon heat development, and the rate of dimensional change over time after heat development in the same manner as in Example 1. The results are shown in Table 25.

TABLE 24

| Sample No. | No. of support with back layer/undercoat layer | Generation of wrinkles | Rate of dimensional change upon heat development | | Rate of dimensional change over time at 20% RH | | Rate of dimensional change over time at 75% RH | |
|---|---|---|---|---|---|---|---|---|
| | | | MD (%) | TD (%) | MD (%) | TD (%) | MD (%) | TD (%) |
| 1 | I-1 | Present | −0.155 | 0.815 | 0.001 | 0 | 0.012 | 0.011 |
| 2 | I-2 | Absent | −0.005 | 0.014 | 0 | 0 | 0.010 | 0.009 |
| 3 | I-3 | Absent | −0.009 | 0.019 | 0.001 | 0 | 0.010 | 0.010 |
| 4 | I-4 | Absent | −0.010 | 0.024 | 0.001 | 0 | 0.010 | 0.009 |
| 5 | I-5 | Absent | −0.026 | 0.037 | −0.001 | 0 | 0.009 | 0.010 |
| 6 | I-6 | Absent | −0.005 | 0.014 | −0.001 | 0 | 0.009 | 0.010 |
| 7 | I-7 | Absent | −0.004 | 0.011 | 0 | 0 | 0.010 | 0.010 |
| 8 | I-8 | Absent | −0.030 | 0.025 | 0 | 0 | 0.010 | 0.009 |
| 9 (Comparative) | II-1 | Present | −0.156 | 0.810 | 0.002 | 0.001 | 0.044 | 0.044 |
| 10 (Comparative) | II-2 | Absent | −0.006 | 0.015 | 0.001 | 0.001 | 0.043 | 0.044 |
| 11 (Comparative) | II-3 | Absent | −0.009 | 0.020 | 0.001 | 0 | 0.044 | 0.043 |
| 12 (Comparative) | II-4 | Absent | −0.011 | 0.026 | 0.001 | 0.001 | 0.043 | 0.044 |
| 13 (Comparative) | II-5 | Absent | −0.025 | 0.034 | 0.001 | 0.001 | 0.044 | 0.043 |
| 14 (Comparative) | II-6 | Absent | −0.006 | 0.014 | 0.001 | 0.001 | 0.043 | 0.043 |
| 15 (Comparative) | II-7 | Absent | −0.004 | 0.012 | 0.001 | 0.001 | 0.043 | 0.042 |
| 16 (Comparative) | II-8 | Absent | −0.032 | 0.027 | 0.001 | 0.001 | 0.044 | 0.045 |

MD: Machine direction,
TD: Transverse direction

As clearly indicated by the results shown in Table 24, it was understood that the samples of the present invention exhibited small dimensional changes over time after the heat development. The aforementioned samples utilized biaxially stretched PET supports. Therefore, by subjecting the samples to heating, the generation of wrinkles can be eliminated, and the dimensional change upon heat development can be made small. Therefore, it can be seen that, by using a heat-treated support, the generation of wrinkles can be eliminated, and both of the dimensional change upon heat development and the dimensional change over time after the heat development can be made extremely small. In particular, it can be seen that good results can be obtained by using a support subjected to a heat treatment under the preferred conditions.

EXAMPLE 2

PET supports with various values as for the thickness of the vinylidene chloride copolymer layer of Undercoat layer Further, coating surface condition of the vinylidene chloride copolymer layer was evaluated in accordance with the following criteria, and the results are shown in Table 25 with ○, Δ or X.

4) Evaluation of Coating Surface Condition ○: Coating ununiformity, repellency etc. are not observed by visual observation.

Δ: Coating ununiformity, repellency etc. are observed in such a degree that they are hardly observed by visual observation.

X: Coating ununiformity, repellency etc. are clearly observed by visual observation.

TABLE 25

| Sample No. | Thickness of vinylidene chloride copolymer layer (μm) | Generation of wrinkles | Rate of dimensional change upon heat development MD (%) | Rate of dimensional change upon heat development TD (%) | Rate of dimensional change over time at 75% RH MD (%) | Rate of dimensional change over time at 75% RH TD (%) | Condition of coated surface of vinylidene chloride copolymer layer |
|---|---|---|---|---|---|---|---|
| 21 (Comparative) | 0.1 | Absent | −0.005 | 0.014 | 0.038 | 0.036 | ○ |
| 22 | 0.3 | Absent | −0.004 | 0.014 | 0.020 | 0.019 | ○ |
| 23 | 0.6 | Absent | −0.005 | 0.013 | 0.015 | 0.014 | ○ |
| 24 | 1.0 | Absent | −0.006 | 0.014 | 0.013 | 0.012 | ○ |
| 25 | 2.0 | Absent | −0.005 | 0.014 | 0.010 | 0.010 | ○ |
| 26 | 3.0 | Absent | −0.004 | 0.013 | 0.010 | 0.009 | ○–Δ |
| 27 | 4.0 | Absent | −0.004 | 0.013 | 0.010 | 0.009 | ○–Δ |

MD: Machine direction,
TD: Transverse direction

As is clearly shown by the results mentioned in Table 25, it could be seen that the samples of the present invention exhibited no generation of wrinkles, and had a small dimensional change upon the heat development and a small dimensional change over time after the heat development, i.e., the samples showed good results.

According to the present invention, the dimensional change over time after the heat development can reduced. Moreover, the generation of wrinkles upon the heat development and the dimensional change before and after the heat development can be eliminated. Especially, as for a polyester support, by using a support which is coated as for its both sides with the undercoat layers of vinylidene chloride copolymer of a defined thickness and subjected to the predetermined desirable heat treatment, a heat-developable image-recording material exhibiting extremely small dimensional change before and after the heat development and dimensional change over time after the heat development can be obtained.

What is claimed is:

1. A heat-developable image-recording material which has an image-forming layer containing an organic silver salt, reducing agent, and light-sensitive silver halide on the support, wherein the heat-developable image-recording material is heat-developed at a development temperature of from 80° C. to 140° C., and comprises, on both sides of a support composed of biaxially stretched polyester, undercoat layers comprising a vinylidene chloride copolymer containing 70–99.9% by weight of vinylidene chloride monomer repeating units and 0.1–5% by weight of carboxyl group-containing vinyl monomer repeating units and having a thickness of 0.3 μm or more for each, and wherein the support is subject to heat treatment under a conveying tension of 0.5 kg/cm$^2$ to 7 kg/cm$^2$ after the undercoat layers are coated on the support.

2. The heat-developable image-recording material of claim 1, which has at least one protective layer on the image-forming layer.

3. The heat-developable image-recording material of claim 1, wherein the vinylidene chloride copolymer has a weight average molecular weight of 45000 or less.

4. The heat-developable image-recording material of claim 1, which uses a polymer latex as binders of the image-forming layer and the protective layer.

5. The heat-developable image-recording material of claim 1, wherein the heat-developable image-recording material is heat-developed after imagewise exposure.

6. The heat-developable image-recording material of claim 5, wherein the development time is from 1 to 180 seconds.

7. The heat-developable image-recording material of claim 1, wherein the undercoat layers are not stretched.

8. A heat-developable image-recording material which is heat-developed at a development temperature of from 80° C. to 140° C., and comprises, on both sides of a support composed of biaxially stretched polyester, undercoat layers comprising a vinylidene chloride copolymer containing 70–99.9% by weight of vinylidene chloride monomer repeating units and 0.1–5% by weight of carboxyl group-containing vinyl monomer repeating units and having a thickness of 0.3 μm or more for each, wherein the support is subject to heat treatment at a temperature of 130° C. to 185° C. under a conveying tension of 0.5 kg/cm$^2$ to 7 kg/cm$^2$ after the undercoat layers are coated on the support.

9. The heat-developable image-recording material of claim 8, wherein rate of heat dimensional change of the heat-treated support when it is heated at 120° C. for 30 seconds is −0.03% to 0.01% for the machine direction (MD), and 0% to 0.04% for the transverse direction (TD).

10. The heat-developable image-recording material of claim 8, wherein the coated support after heat treatment at a temperature of 130° C. to 185° C. has a heat dimensional change when heated to 120° C. for 30 seconds of −0.03% to 0.01% for the machine direction and 0% to 0.04% for the transverse direction.

11. The heat-developable image-recording material of claim 8, wherein the undercoat layers are not stretched.

12. A heat-developable image-recording material which has an image-forming layer containing an organic silver salt, reducing agent, and light-sensitive silver halide on the support, wherein the heat-developable image-recording material is heat-developed at a development temperature of from 80° C. to 140° C., and comprises, on both sides of a support composed of biaxially stretched polyester, undercoat layers consisting essentially of a vinylidene chloride copolymer, and optionally a crosslinking agent, matting agent, antifoggant, stabilizer, and/or stabilizer precursor, wherein the vinylidene chloride copolymer contains 70–99.9% by weight of vinylidene chloride monomer repeating units and 0.1–5% by weight of carboxyl group-containing vinyl monomer repeating units and having a thickness of 0.3 μm or more for each, and wherein the support is subject to heat treatment under a conveying tension of 0.5 kg/cm$^2$ to 7 kg/cm$^2$ after the undercoat layers are coated on the support.

13. The heat-developable image-recording material of claim 12, wherein the matting agent comprises an inorganic component selected from the group consisting essentially of titanium oxide, aluminum oxide, zinc carbonate, calcium carbonate, barium sulfate, calcium sulfate, calcium silicate, and aluminum silicate.

* * * * *